US009382631B1

(12) United States Patent
Villegas

(10) Patent No.: US 9,382,631 B1
(45) Date of Patent: Jul. 5, 2016

(54) MULTI USE CATHODIC PROTECTION SYSTEM FOR STEEL AND REINFORCED CONCRETE AND METHOD OF USE

(71) Applicant: Christian Villegas, Palm Bay, FL (US)

(72) Inventor: Christian Villegas, Palm Bay, FL (US)

( * ) Notice: Subject to any disclaimer, the term of this patent is extended or adjusted under 35 U.S.C. 154(b) by 0 days.

(21) Appl. No.: 14/793,665

(22) Filed: Jul. 7, 2015

(51) Int. Cl.

| | |
|---|---|
| ***C23F 13/00*** | (2006.01) |
| ***C23F 13/14*** | (2006.01) |
| ***C23F 13/18*** | (2006.01) |
| ***C23F 13/20*** | (2006.01) |

(52) U.S. Cl.
CPC ..... *C23F 13/14* (2013.01); *C23F 13/18* (2013.01); *C23F 13/20* (2013.01); *C23F 2201/02* (2013.01)

(58) Field of Classification Search
CPC ..... C23F 13/02; C23F 13/06; C23F 13/10; C23F 13/18; C23F 2201/02; C23F 2213/20; C23F 2213/21; C23F 2213/30
USPC ..... 204/196.01, 196.3, 196.36
See application file for complete search history.

(56) References Cited

U.S. PATENT DOCUMENTS

| | | | | |
|---|---|---|---|---|
| 5,968,339 | A * | 10/1999 | Clear | 205/730 |
| 2002/0108338 | A1 * | 8/2002 | Barnett et al. | 52/309.16 |
| 2005/0077191 | A1 * | 4/2005 | Whitmore | 205/734 |
| 2009/0229993 | A1 * | 9/2009 | Glass et al. | 205/734 |

FOREIGN PATENT DOCUMENTS

WO WO 9630561 A1 * 10/1996

OTHER PUBLICATIONS

Tarou et al (Structure Magazine, Sep. 2007, pp. 15-19).*

* cited by examiner

*Primary Examiner* — Luan Van
*Assistant Examiner* — ALexander W Keeling
(74) *Attorney, Agent, or Firm* — Eric R. Benson

(57) ABSTRACT

This invention is a device that provides a multi use cathodic protection system for steel and reinforced concrete and method of use that will permit a user to more easily and accurately place an impressed current cathodic protection system, a sacrificial or galvanic anode cathodic protection system, or combination thereof around a reinforced structure to be protected and thereafter fill with concrete by use of a uniquely engineered fiberglass reinforced plastic form. This invention once put in place around the structure being protected can more easily be filled with concrete without having the attached titanium mesh or zinc anode mesh bend or move outside of the effective proximity from the protected structure. The fiberglass reinforced plastic form has a corrugated or roughed surface that provides an increased surface area to bind or grip the fiberglass reinforced plastic form to the poured concrete once cured.

11 Claims, 20 Drawing Sheets

ITEM# 1 DETAILS

ITEM# 2 DETAILS

ITEM# 3 DETAILS

ITEM# 4 DETAILS

ITEM# 5 DETAILS

ITEMS# 7&8 DETAILS

MULTI USE CATHODIC PROTECTION SYSTEM FOR STEEL AND REINFORCED CONCRETE AND METHOD OF USE

CROSS REFERENCE TO RELATED APPLICATION

This Application claims priority from the Applicant's Provisional Patent Application No. 62/155,588, which was filed on May 1, 2015.

FIELD OF THE INVENTION

This invention relates generally to cathodic protection systems and more particularly to a multi use cathodic protection system for protecting steel and steel reinforced structures in various applications including marine applications.

BACKGROUND ART

The corrosion of metals and reinforced concrete has been a persistent problem in our modern post industrial revolution world that has cost billions of dollars and many lives. For instance in 1967 the sudden collapse because of corrosion fatigue of the Silver Bridge over the Ohio River at Point Pleasant, Ohio resulted in the loss of 46 lives and cost millions of dollars. In 1983, the Michael L. Morano Bridge crossing the Mianus River on I-95 in Connecticut collapsed because of corrosion. Three people were killed in that collapse and the tragedy spurred a reaction by the Connecticut General Assembly to establish a $5.5 Billion bridge and highway renovation program. The collapse of the Algo Centre Mall's roof in Elliot Lake Ontario in June of 2012, was found to have been caused by the corrosion of a steel beam due to water leakage that brought a portion of the concrete structure crashing down two stories. That collapse killed two women and injured 20 more.

The corrosion process of reinforcing steel that takes place in concrete is electrochemical. When electrons commence flowing between anodic and cathodic sites on the reinforcing rod in the concrete the process of corrosion begins. Corrosion requires four basic elements in order to occur: 1) an anode site where current flows from and corrosion takes place, i.e. a site on the steel reinforcing rod; 2) a cathode site where no corrosion occurs and to which current flows; 3) an electrolyte medium capable of conducting electric current by ionic current flow such as soil, water or concrete; and 4) a metallic pathway or connection between the anode and cathode, which permits the electrical current to return and complete the circuit. By design the reinforcing steel in concrete should not normally corrode because of the formation of a passive oxide film on the surface of the steel. The hydration of cement in freshly poured concrete has a very high alkalinity that reacts with oxygen to stabilize the passive oxide film on the surface of concrete embedded reinforcing rod. The passive oxide film should provide continued protection so long as the alkalinity is maintained. Concrete typically has a pH above 12 largely due to the presence of sodium hydroxide, calcium hydroxide and potassium hydroxide. Despite these facts, how this passive oxide film protects the metal is not known, it appears to isolate the metal from the environment and thereby retards the corrosion of the metal as long as the film is intact.

The two most significant causes of the corrosion of reinforcing steel are chloride contamination and carbonation. Chloride contamination caused corrosion of reinforcement steel is well documented. In most instances chloride ions enter into the concrete as a result of de-icing salts or from seawater in marine environments. The other common sources of chloride contamination are: 1) contaminated aggregates and/or mixing water, 2) chloride containing admixtures which are used to accelerate curing of concrete; 3) air born salts; 4) salts in ground water; and 5) the salts in chemicals that may be applied to concrete surfaces. When chloride ions are present in sufficient quantity they will chemically disrupt the passive oxide film on the reinforcing steel and corrosion will then take place.

Carbonation of a reinforced concrete structure takes place when $CO_2$ from the atmosphere diffuses through the porous concrete. Once diffused in the concrete the $CO_2$ neutralizes the alkalinity of the concrete. The pH of 12 necessary to maintain the passive oxide film on the reinforcing steel will drop dramatically as a result of carbonation to as low as 8 resulting in a destabilization of the passive oxide film. Without the protection of the passive oxide film oxygen and water present in the concrete will cause the metal to corrode. Carbonation is typically a slow process that depends primarily on the porosity and permeability of the concrete. It is rarely a problem on structures that are built with good quality concrete with adequate depth of cover over the reinforcing steel.

The prior art teaches many methods and devices engineered to slow down the corrosion process of metals in reinforced concrete structures. Cathodic protection (hereinafter "CP"), however, is the only method proven to stop corrosion in existing reinforced concrete structures. In the art it is understood that CP is defined as the reduction or elimination of corrosion by making the metal a cathode via an impressed direct current (DC), or by connecting it to a sacrificial or galvanic anode. CP is achieved in two basic ways. The metal being protected is made into a cathode by either: 1) impressing a direct current (DC); or 2) by connecting the metal to a sacrificial or galvanic anode such as disclosed in U.S. Pat. No. 5,341,562, Furuya, et al. and U.S. Pat. No. 7,160,433, Bennett. The cathodic areas of the metal become an electrochemical cell that will not corrode. The prior art teaches that if all the anode sites were forced to function as current-receiving cathodes then the entire metallic structure would become a cathode and corrosion would be prevented.

CP has been used successfully to protect bridges, underground pipelines, ship hulls, offshore oil platforms, underground storage tanks, and countless other structures that are often exposed to corrosive environments. The effective use of CP on a concrete bridge structure has been known since 1973. As noted above the corrosion process itself generates an electric current. To counteract the current generated by the corrosion CP supplies a source of external current thereby eliminating the corrosion.

It is well known in the art that the life expectancy of an impressed current CP system is much greater than sacrificial or galvanic anodes. For instance a conductive coating sacrificial or galvanic anode system in a marine environment is only expected to last less than 10 years as opposed to a titanium mesh impressed current CP which can function effectively for more than 75 years. Sacrificial or galvanic anodes in turn have the advantage of not requiring an impressed current or battery power supply once the system is charged. Sacrificial or galvanic anodes also utilize less expensive metals such as zinc which in some systems can be replaced once the sacrificial or galvanic anode is decayed beyond its effectiveness. The current jacketed systems that are in use in the art do not provide a reliable method of maintaining either the impressed current systems or the sacrificial or galvanic anodes in place during installation to insure proper function to prevent corrosion of the structure sought to be cathodically protected. The common problem in the current art of deformation of the titanium mesh in the impressed current systems and the zinc mesh of the sacrificial or galvanic anodes systems during the jacket infusion of concrete in particular reduces and in some cases eliminates the effectiveness of the system.

My invention utilizes a jacketed CP system that is capable of effectively utilizing either an impressed current system or a sacrificial or galvanic anode or both in combination. An impressed current CP system for concrete structures is typically comprised of the following basic components: 1) a DC power supply known as a rectifier; 2) an inert anode material such as catalyzed titanium anode mesh; 3) wiring and conduit; and 4) some form of instrumentation such as an embedded silver/silver-chloride reference electrode. A CP sacrificial or galvanic anode system for reinforced concrete uses a more reactive metal (anode) such as zinc or aluminum-zinc-indium (Al—Zn—In), to create a current flow. Sacrificial anode systems are based on the principle of dissimilar metal corrosion and the relative position of different metals in the galvanic series. The direct current is generated by the potential difference between the anode and reinforcing steel when connected and requires no external power supply. The sacrificial anode will corrode during the process and is consumed. Current will flow from the anode, through the concrete, to the corroding reinforcing steel.

While the electrochemistry of impressed current and sacrificial or galvanic anode CP systems are well known in the prior art the challenge in constructing an effective CP system lies in the manner in which such devices attach to a structure while maintaining effective electrical connections that can reliably maintain the metal or reinforced concrete structure being protected as a cathode. Several impressed current CP systems exist in the prior art. For example in U.S. Pat. No. 4,080,272, Ferry, et al. teaches a method and apparatus for determining the true cathode polarization potential for automatically regulating the impressed current in a cathodic protection system; and U.S. Pat. No. 8,557,089, Schutt teaches a cathodic protection system for marine applications utilizing an impressed current. Similarly, several sacrificial or galvanic anode CP systems also exist in the prior art. For example in U.S. Pat. No. 7,704,372, Glass et al. teaches a sacrificial anode assembly in the form of a cell. Additionally, the combination of impressed current and sacrificial or galvanic anodes in one CP system is also taught in U.S. Pat. No. 8,999,137, Glass et al.

Typically when an existing structure is sought to be protected by an impressed current CP system a fiberglass reinforced plastic form (FRP form) is placed around the structure that is being protected by the device. The FRP form has disposed within it a titanium mesh connected to a current distribution titanium bar that will be connected to the DC power source or rectifier. Once the FRP form is secured in place it is filled with concrete that is typically pumped into the form. In like manner, typically when an existing structure is sought to be protected by a sacrificial or galvanic anode CP system a fiberglass reinforced plastic form (FRP form) is also placed around the structure that is being protected by the device. The FRP form has disposed within it a zinc or aluminum-zinc-indium mesh that will act as the sacrificial anode in the system. In this system as well once the FRP form is secured in place it is filled with concrete that is typically pumped into the form. A CP system that utilizes both an impressed current and a sacrificial or galvanic anode would have both the titanium and the zinc or aluminum-zinc-indium mesh disposed within the FRP form. Several problems have plagued current art jacketed CP systems such as achieving an even flow of the concrete inside the FRP form with the mesh attached to it without damaging the mesh. Another common problem in the prior art is that the mesh will often create a short circuit by touching the inside reinforcement steel because there is no effective means for retaining the mesh in optimal placement within the jacket during the installation process.

Prior art systems do not maintain the mesh at the proper distance from the steel reinforcement that is being protected. Another common problem with the prior art occurs during assembly and pumping of the concrete into the FRP form when the mesh folds over at the corners and joints of the FRP form toward or away from the steel reinforcement sought to be protected. Prior art systems also lack an effective bottom form or locking system at the joints of the FRP form necessary to prevent concrete leaks as the form is being pumped full of concrete. Also FRP forms of prior art systems will often disengage and separate from the concrete due to the lack of an effective attachment means between the interior surface of the FRP form and the concrete.

DISCLOSURE OF THE INVENTION

Purpose of Invention

The purpose of the invention is to provide a CP system and method of use that will permit a user to more easily and accurately place an: impressed current; sacrificial or galvanic anode; or combination impressed current and sacrificial or galvanic anode, cathodic protection system around a steel or steel reinforced structure to be protected and thereafter fill with concrete by use of a uniquely engineered fiberglass reinforced plastic form assembly. This invention once put in place around the structure being protected can more easily be filled with concrete without having the attached corresponding mesh bend or move outside of its effective proximity from the protected structure or leak concrete from the form. The fiberglass reinforced plastic form has a corrugated or roughed surface that provides an increased surface area to bind the fiberglass reinforced plastic form to the poured concrete once cured. Additionally the CP system utilizes corrosion resistant materials to effectuate and prolong the dependability of its electrical connections.

Description of Problems Solved by Invention

Thus, while there are a number of prior art attempts to solve the problems identified above none of these devices are satisfactory solutions. Therefore there is a great need for an impressed current, sacrificial or galvanic anode, or combination impressed current and sacrificial or galvanic anode, corrosion protection system and method of use that solves these problems. My invention is designed to solve these problems that exist in the current art. Specifically my invention utilizes a PVC pumping port and support structures that are designed to keep the corresponding mesh at a distance from the wall of the FRP form and the steel reinforcing without interfering with the pumping process.

My invention utilizes a configuration of nylon spaced hardware that stretch and keep the corresponding mesh still during pumping and at the proper distance from the key limits. Additionally my invention utilizes a series of distance aligned FRP brackets that are attached to the FRP form with nylon ties that are attached to the corresponding mesh to hold the mesh in place at the corners and at the joint of the locking seams of the two halves of the FRP form. My invention also uses an FRP bottom form and a click-n-lock system with a rubber seal at the FRP form joints where the two halves of the FRP form meet to securely close the jacket formed by the two halves of the FRP form without the need to use expensive epoxy to prevent concrete leakage. To solve the FRP form separation problem my invention utilizes a FRP form with a heavy duty uniformly corrugated or roughed inside surface engineered to form a grip and hold between the concrete being poured and the inside surface of the FRP in lieu of sand blasting or tooling to create that type of surface.

Additionally for both the impressed current and the sacrificial or galvanic anode CP system my invention utilizes corrosion resistant materials to effectuate and prolong the dependability of its electrical connections.

Brief Description of Invention

My invention is a three system in one cathodic protection system that is specifically engineered to permit a user, often times in very difficult circumstances, such as in underwater applications, to more easily secure in place a user selected cathodic protection system utilizing either: an impressed current; a sacrificial or galvanic anode; or combination impressed current and sacrificial or galvanic anode, cathodic protection system and effectively pump it full of concrete wherein the concrete will be fully dispersed inside the jacket formed by the device while simultaneously maintaining the corresponding mesh that will act as the anode(s) in the system at the proper distances necessary while completely encasing it in the poured concrete. The interior of the jacket that is utilized in all three embodiments that is formed by the device has a corrugated or roughed surface specifically engineered to increase the surface area for more effective bonding and adhesion of the poured concrete with the jacket.

BEST MODES FOR CARRYING OUT THE INVENTION

I. Preferred Embodiments

With reference now to the drawings, and in particular to FIGS. 1-20 thereof, are depicted three embodiments of a new and novel Multi Use Cathodic Protection System for Steel and Reinforced Concrete. Each of the embodiments utilize certain component parts that are identical in each of the three embodiments and therefore the numbered parts that are the same are identified and numbered the same in FIGS. 1-20.

A. Impressed Current Embodiment of the Multi Use Cathodic Protection System for Steel and Reinforced Concrete With reference now to the drawings, and in particular to FIGS. 1-9 thereof, are depicted the impressed current embodiment of a new and novel Multi Use Cathodic Protection System for Steel and Reinforced Concrete.

Figure 1:
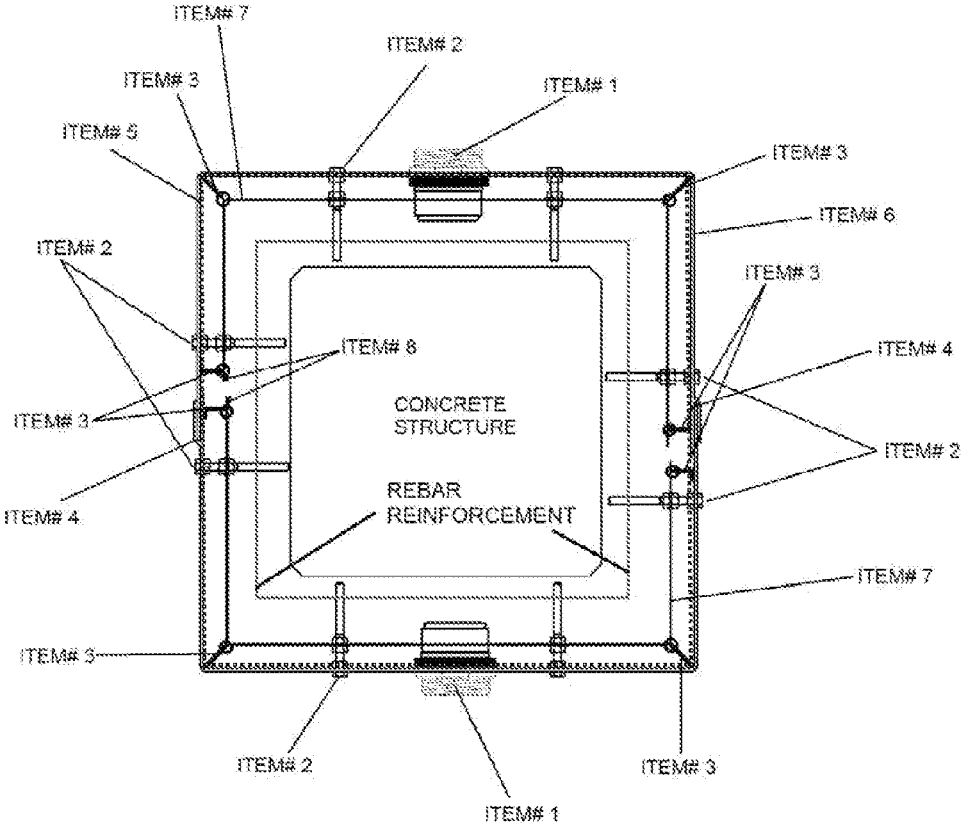
FIG. 1 is a perspective top view of the impressed current embodiment of the Multi Use Cathodic Protection System for Steel and Reinforced Concrete placed in an operative position around a reinforced concrete structure and showing the placement of the PVC Port Assembly, the Spacer/Tensor Assemblies, the Click-N-Lock Joint Assembly, the Roughed Inside Surface, and the Titanium Mesh.

FIG. 1 depicts the impressed current embodiment of the Multi Use Cathodic Protection System for Steel and Reinforced Concrete placed around a reinforced concrete structure to be provided cathodic protection by the device which is comprised of two Fiberglass Reinforced Plastic Forms (ITEM#6). The two Fiberglass Reinforced Plastic Forms (ITEM#6) are held together to form a jacket by two Click-N-Lock Joint Assemblies (ITEM#4). Each of the two Fiberglass Reinforced Plastic Forms (ITEM#6) having a PVC Port Assembly (ITEM#1), a multiplicity of Spacer/Tensor Assemblies (ITEM#2) that work in conjunction with a multiplicity of Bracket/Tie Assemblies (ITEM#3) to maintain a Titanium Mesh (ITEM#7) at an optimal functional distance from the surface of the Fiberglass Reinforced Plastic Forms (ITEM#6) and the reinforced concrete structure to be provided cathodic protection by the device. Also depicted are the Roughed Inside Surface (ITEM#5) and the Current Distribution Titanium Bar (ITEM#8) that are spot welded to Titanium Mesh (ITEM#7).

Figure 2:
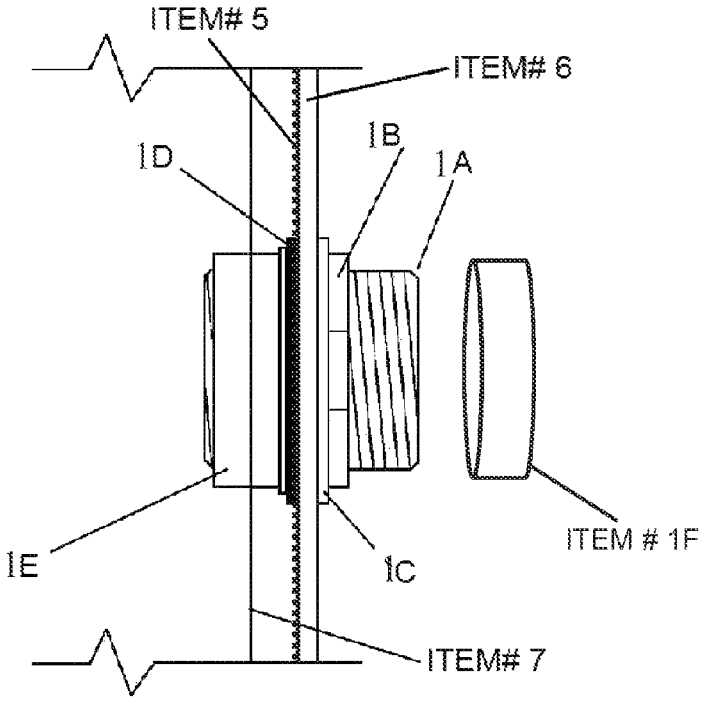
FIG. 2 is a cutaway perspective side view of the PVC Port Assembly of the impressed current embodiment of the Multi Use Cathodic Protection System for Steel and Reinforced Concrete placed in an operative position with the Fiberglass Reinforced Plastic Form and Titanium Mesh.

FIG. 2 depicts the PVC Port Assembly (ITEM#1) of the impressed current embodiment of the Multi Use Cathodic Protection System for Steel and Reinforced Concrete which is further comprised of a PVC Port (1A), a Port Lock Nut (1B), a Port Washer (1C) a Port Seal (1D), a Port Mesh Holder (1E) and a PVC Port Cap (1F). Also depicted are the Roughed Inside Surface (ITEM#5) and the Titanium Mesh (ITEM#7) through which the interior portion of the PVC Port Assembly (ITEM#1) passes.

Figure 3:
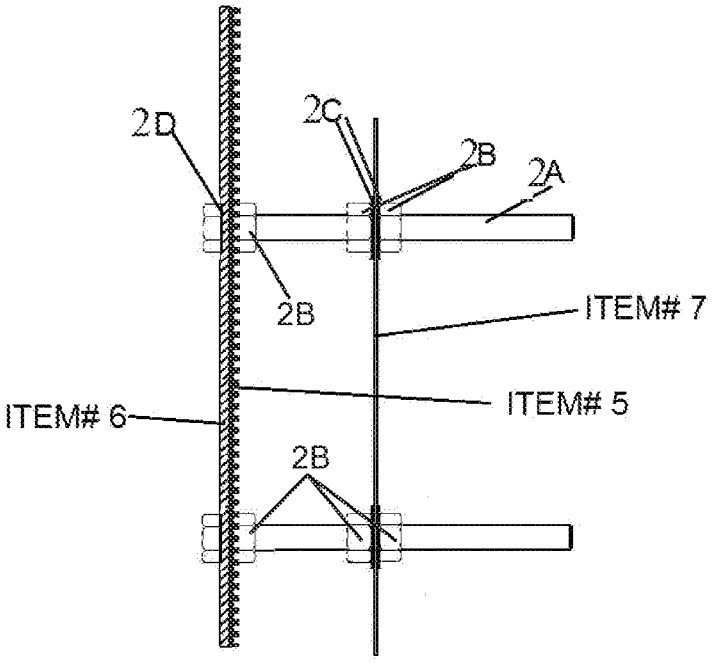
FIG. 3 is a perspective side view of the Spacer/Tensor Assembly of the impressed current embodiment of the Multi Use Cathodic Protection System for Steel and Reinforced Concrete attached to the Fiberglass Reinforced Plastic Form with Roughed Inside Surface and Titanium Mesh.

FIG. 3 depicts two of the Spacer/Tensor Assemblies (ITEM#2) functionally attached to the Titanium Mesh (ITEM#7) at an optimal functional distance from the surface of the Fiberglass Reinforced Plastic Forms (ITEM#6). The two Spacer/Tensor Assemblies (ITEM#2) are each depicted therein being further comprised of a Spacer/Tensor Bolt (2A), three Spacer/Tensor Nuts (2B), two Spacer/Tensor Washers (2C), and a Spacer/Tensor O-Ring (2D).

Figure 3A:
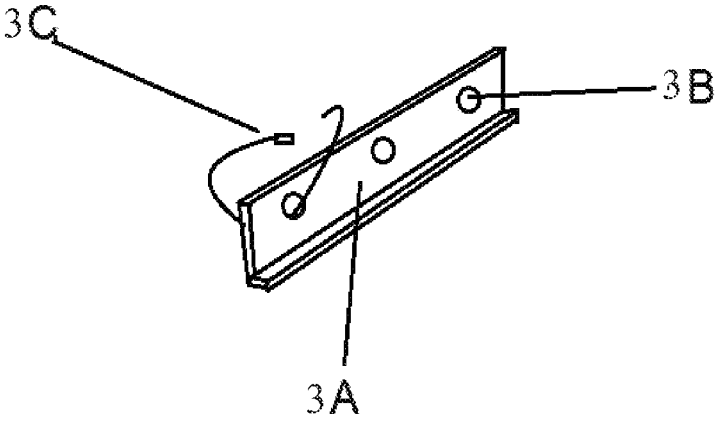
FIG. 3A is a perspective side view of the Bracket/Tie Assembly of the impressed current embodiment of the Multi Use Cathodic Protection System for Steel and Reinforced Concrete comprised of a Fiberglass Reinforced Plastic Bracket, Bracket/Tie Holes and Bracket/Tie Tie

FIG. 3A depicts the Bracket/Tie Assembly (ITEM#3) which is further comprised of a Fiberglass Reinforced Plastic Bracket (3A), a multiplicity of Bracket/Tie Holes (3B) and at least one Bracket/Tie Tie (3C).

Figure 4:
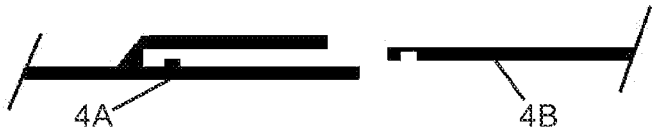
FIG. 4 is a perspective top view of the Click-N-Lock Joint Assembly of the impressed current embodiment of the Multi Use Cathodic Protection System for Steel and Reinforced Concrete in the open or unlocked condition.

FIG. 4 depicts the Click-N-Lock Joint Assembly (ITEM#4) in the unlocked condition which is comprised of a Clasp (4A) and a Clasp Insert (4B).

Figure 4A:
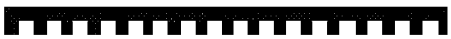
FIG. 4A is a perspective top view of the Roughed Inside Surface of the impressed current embodiment of the Multi Use Cathodic Protection System for Steel and Reinforced Concrete.

FIG. 4A depicts the Roughed Inside Surface (ITEM#5) of the Fiberglass Reinforced Plastic Form (ITEM#6).

Figure 4B:
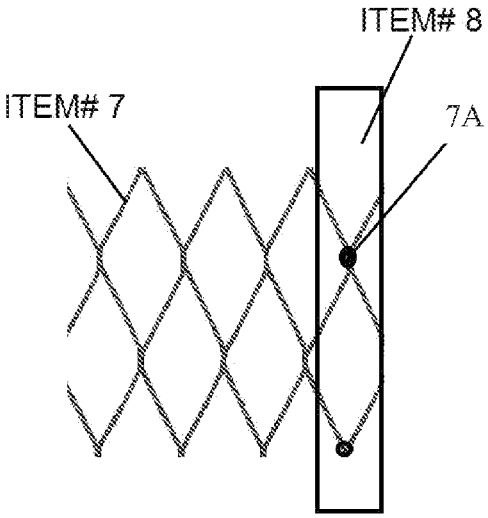
FIG. 4B is a cutaway perspective side view of the Titanium Mesh of the impressed current embodiment of the Multi Use Cathodic Protection System for Steel and Reinforced Concrete with Spot Welds attaching the Titanium Mesh to a titanium CD Bar.
Figure 5:
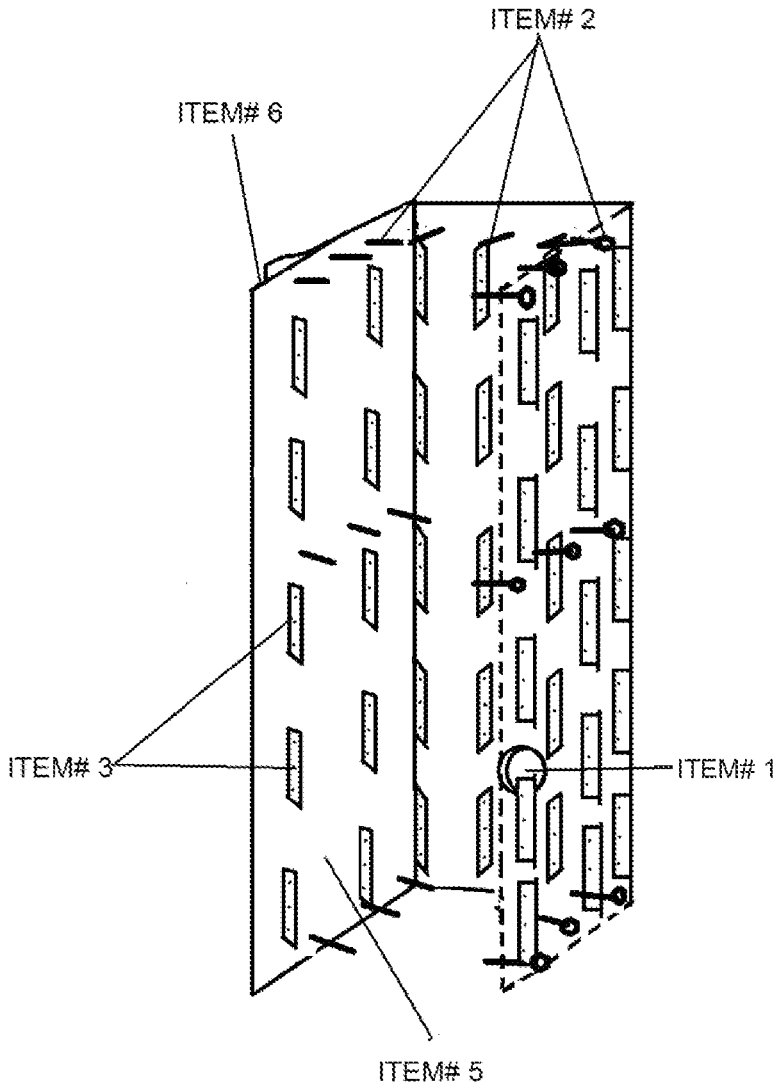
FIG. 5 is a perspective inside view of one of the two Fiberglass Reinforced Plastic Forms used to form the jacket of the impressed current embodiment of the Multi Use Cathodic Protection System for Steel and Reinforced Concrete showing the placement of the PVC Port Assembly, the Spacer/Tensor Assemblies, the Bracket/Tie Assemblies and the Roughed Inside Surface.
Figure 6:
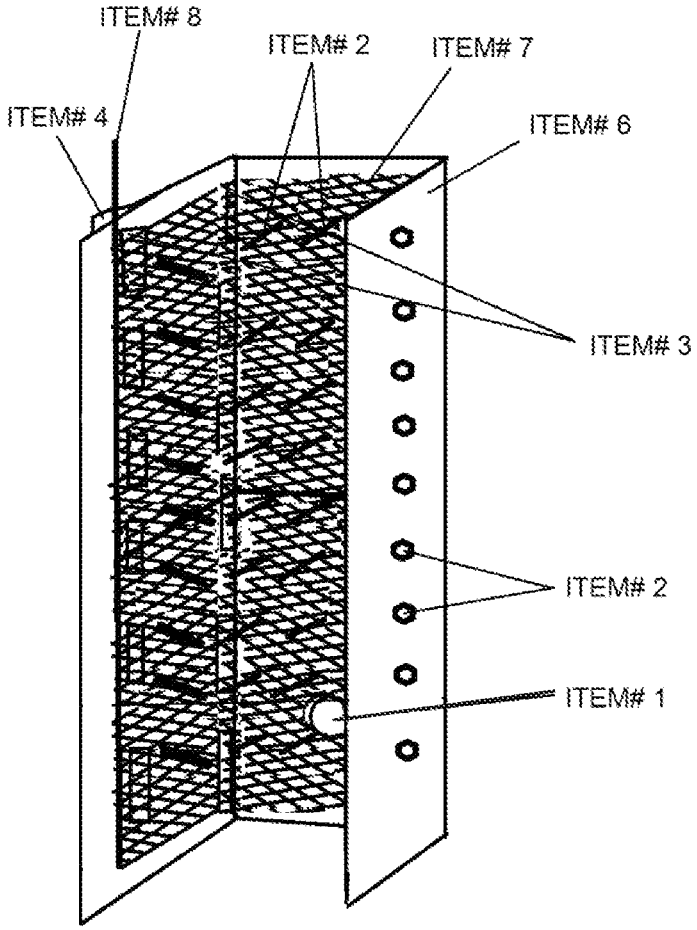
FIG. 6 is a perspective inside view of one of the two Fiberglass Reinforced Plastic Forms used to form the jacket of the impressed current embodiment of the Multi Use Cathodic Protection System for Steel and Reinforced Concrete showing the placement of the PVC Port Assembly, the Spacer/Tensor Assemblies, the Bracket/Tie Assemblies, the Click-N-Lock Joint Assembly, the Titanium Mesh, and the Current Distribution Titanium Bar.
Figure 7:
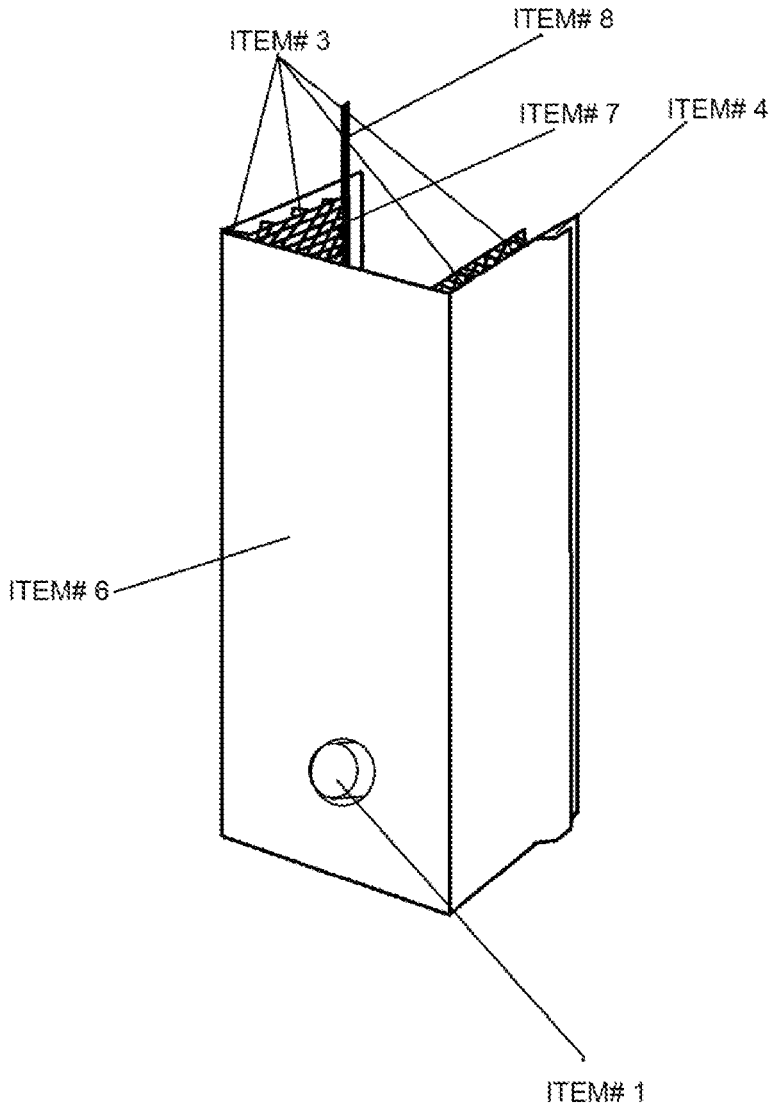
FIG. 7 is a perspective outside view of one of the two Fiberglass Reinforced Plastic Forms used to form the jacket of the impressed current embodiment of the Multi Use Cathodic Protection System for Steel and Reinforced Concrete showing the placement of the PVC Port Assembly, the Bracket/Tie Assemblies, the Click-N-Lock Joint Assembly, the Titanium Mesh, and the Current Distribution Titanium Bar.
Figure 8:
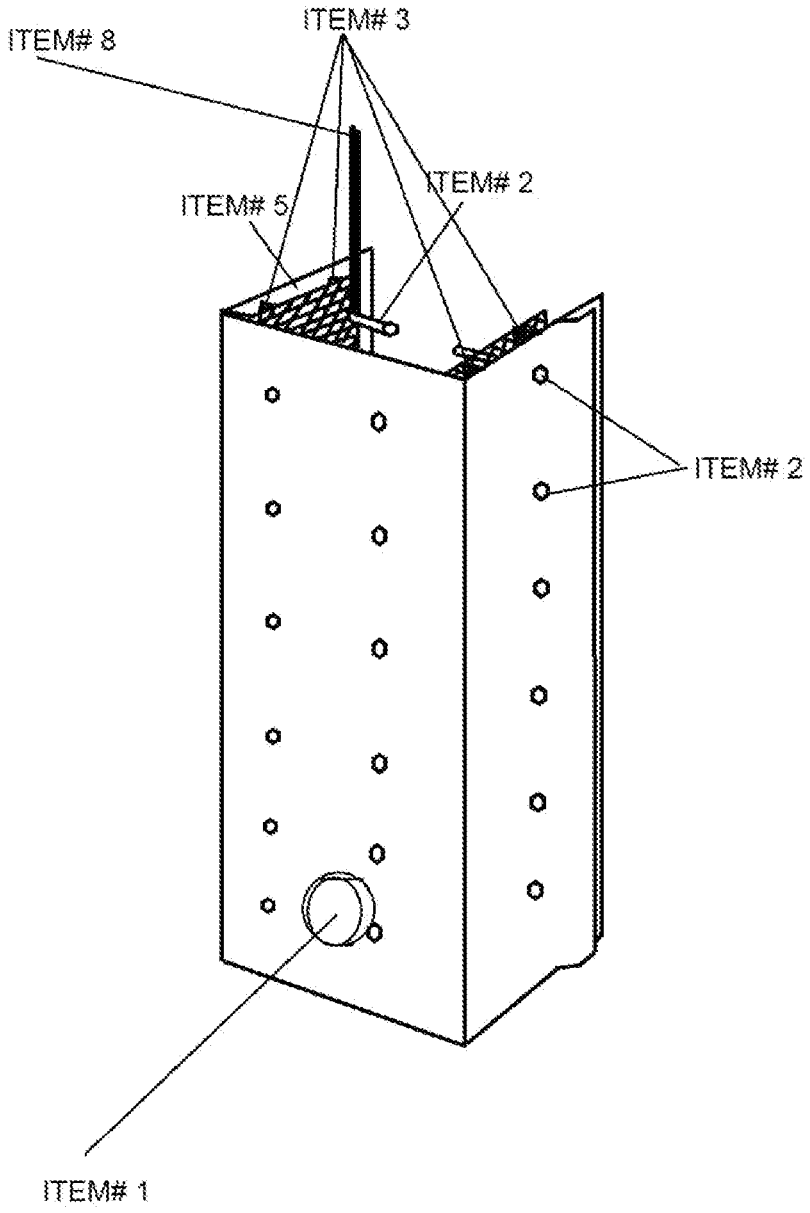
FIG. 8 is a perspective outside view of one of the two Fiberglass Reinforced Plastic Forms used to form the jacket of the impressed current embodiment of the Multi Use Cathodic Protection System for Steel and Reinforced Concrete showing the placement of the PVC Port Assembly, the Spacer/Tensor Assemblies, the Bracket/Tie Assemblies, the Click-N-Lock Joint Assembly, the Roughed Inside Surface, and the Current Distribution Titanium Bar.

FIG. 4B depicts the Titanium Mesh (ITEM#7) which is attached by a multiplicity of Spot Weld (7A) to the Current Distribution Titanium Bar (ITEM#8).

FIGS. 5-8 depict various perspective views of the Fiberglass Reinforced Plastic Form (ITEM#6) used to form the jacket of the impressed current embodiment of the Multi Use Cathodic Protection System for Steel and Reinforced Concrete to show where the various components attach for use of the device.

Figure 9:
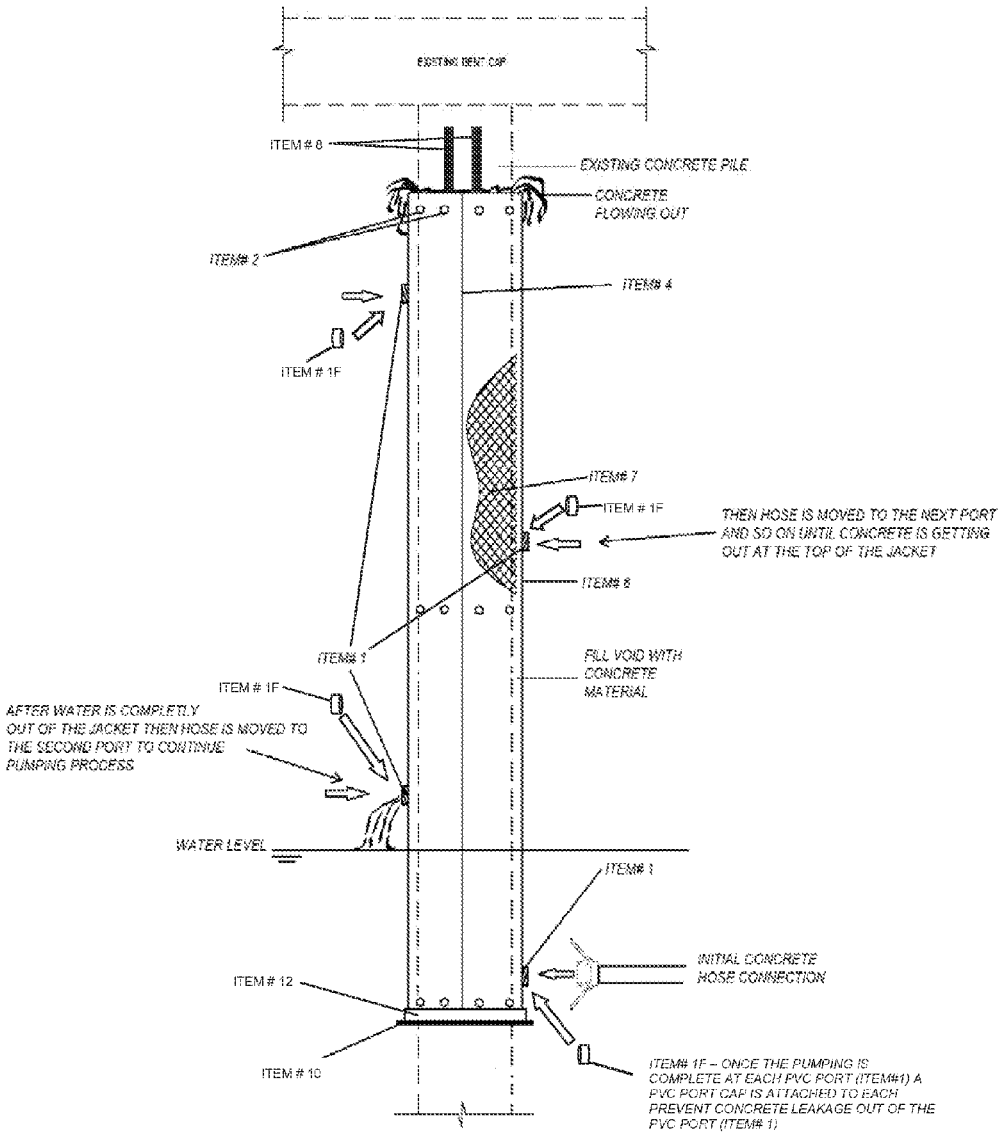
FIG. 9 is a perspective view of the two Fiberglass Reinforced Plastic Forms snapped together to form the jacket of the impressed current embodiment of the Multi Use Cathodic Protection System for Steel and Reinforced Concrete in place around a reinforced concrete structure to be provided cathodic protection by the device showing the placement of the PVC Port Assemblies and describing the process of filling the device with concrete.

FIG. 9 depicts the impressed current embodiment of the Multi Use Cathodic Protection System for Steel and Reinforced Concrete fully assembled around a partially submerged reinforced concrete structure to be cathodically protected and specifying the concrete pumping steps to fill the device with concrete and voiding the interior of the device of water. Also depicted is the Plywood Support Platform (ITEM#10) that is installed as a temporary structure to support Fiberglass Reinforced Plastic Bottom Form (ITEM#12) of the device during the process of assembly of the device and process of filling assembled device with concrete for use.

B. Sacrificial or Galvanic Anode Embodiment of the Multi Use Cathodic Protection System for Steel and Reinforced Concrete With reference now to the drawings, and in particular to FIGS. 10-15 thereof, are depicted the sacrificial or galvanic anode embodiment of a new and novel Multi Use Cathodic Protection System for Steel and Reinforced Concrete.

Figure 10:
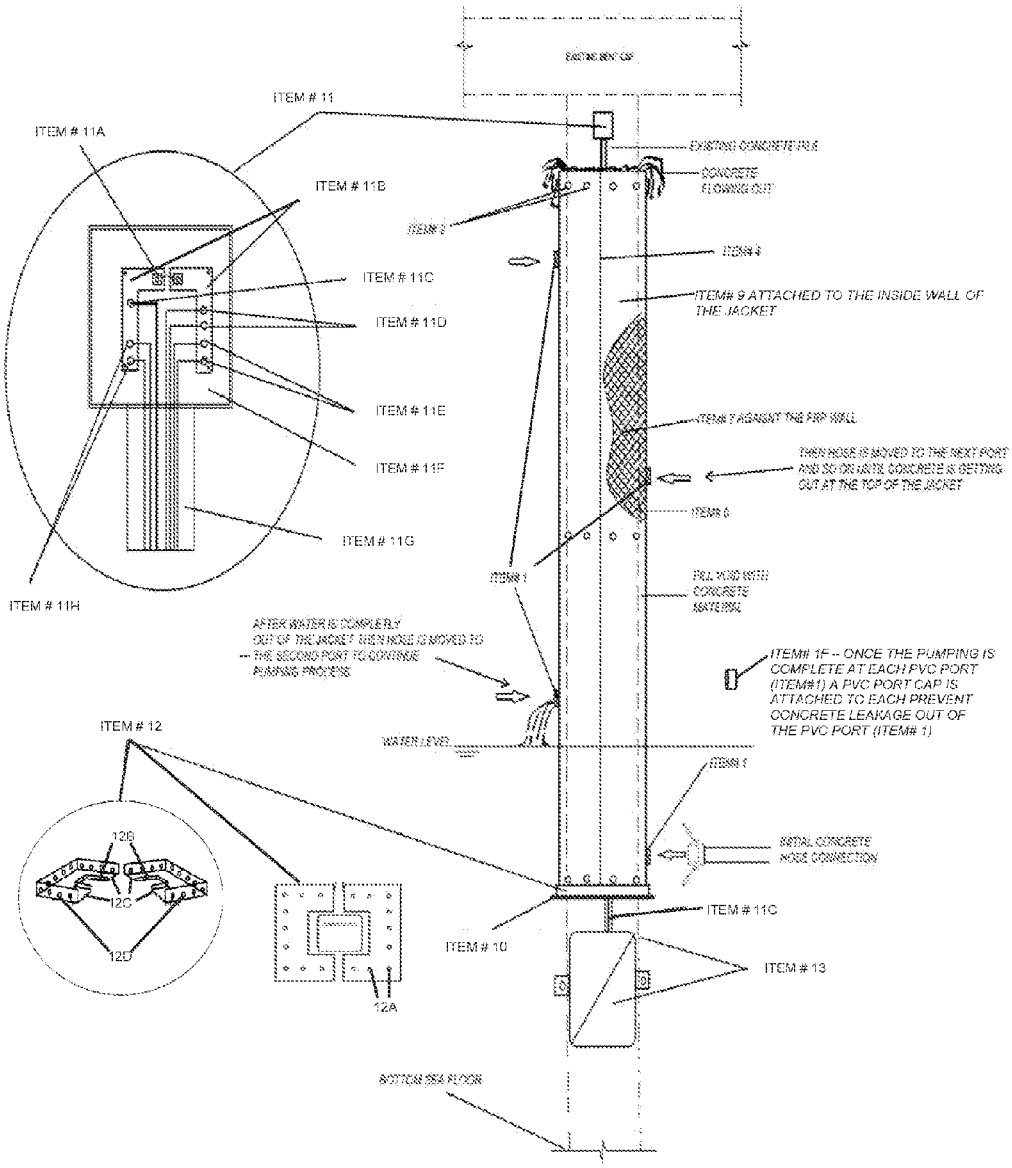
FIG. 10 is a perspective view of the two Fiberglass Reinforced Plastic Forms snapped together to form the jacket of the sacrificial or galvanic anode embodiment of the Multi Use Cathodic Protection System for Steel and Reinforced Concrete in place around a reinforced concrete structure to be provided cathodic protection by the device showing the placement of the PVC Port Assemblies and describing the process of filling the device with concrete together with an exploded view of the Electrical Junction Box.

FIG. 10 depicts the sacrificial or galvanic anode embodiment of the Multi Use Cathodic Protection System for Steel and Reinforced Concrete fully assembled around a partially submerged reinforced concrete structure to be cathodically protected and specifying the concrete pumping steps to fill the device with concrete and voiding the interior of the device of water. Also depicted is the Plywood Support Platform (ITEM#10) that is installed as a temporary structure to support Fiberglass Reinforced Plastic Bottom Form (ITEM#12) of the device during the process of assembly of the device and process of filling assembled device with concrete for use. Once assembled and the concrete has been poured and cured the Plywood Support Platform (ITEM#10) is removed and a multiplicity of Water Ports (12A) are created in the Fiberglass Reinforced Plastic Bottom Form (ITEM#12) to facilitate direct water contact with the Zinc Anode Mesh (ITEM#9) and surrounding concrete to facilitate the flow of electricity through the Zinc Anode Mesh (ITEM#9) from the steel or steel reinforced concrete structure being cathodically protected. The sacrificial or galvanic anode embodiment as depicted is electro-conductively attached to a user selected steel or steel reinforced structure to be cathodically protected by means of an Electrical Junction Box (ITEM#11) which is further comprised of two Negative Wire From Outside Steel Reinforcement (11D) and two Negative Wire From Inside Pile Steel (11E) which in turn are each removably attached to a Non-Corrosive Electrical Block (11B) capable of carrying a current to and through a Shunt (11A) to a second Non-Corrosive Electrical Block (11B) upon which are removably attached: a Bulk Anode Wire (11C) capable of carrying a current to at least one Full Pile Width Bulk Anode (ITEM#13); and two Positive Wire From Zinc Anode Mesh (11H) that is conductively connected to the Zinc Anode Mesh (ITEM#9). The electrical components are protected from the environment by being contained within a Non-Corrosive Box (11F) and Non-Corrosive Conduit (11G).

Figure 11:
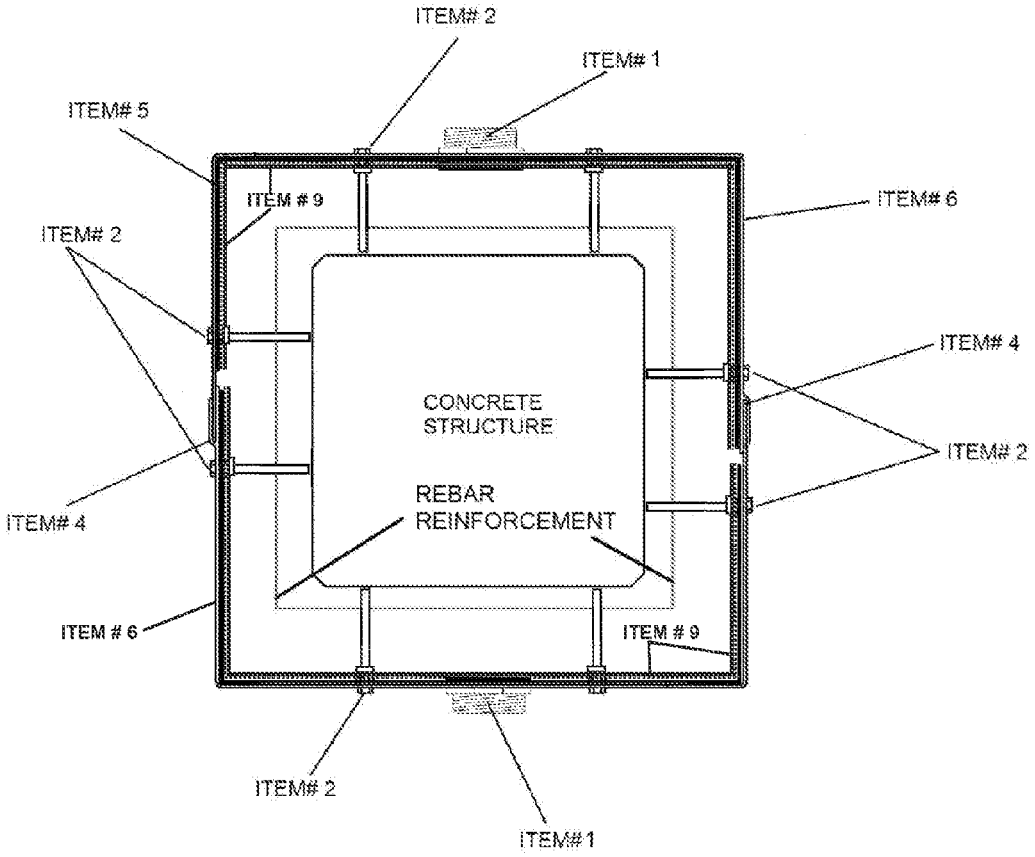
FIG. 11 is a perspective top view of the sacrificial or galvanic anode embodiment of the Multi Use Cathodic Protection System for Steel and Reinforced Concrete placed in an operative position around a reinforced concrete structure and showing the placement of the PVC Port Assembly, the Spacer/Tensor Assemblies, the Click-N-Lock Joint Assembly, the Roughed Inside Surface, and the Zinc Anode Mesh.

FIG. 11 depicts the sacrificial or galvanic anode embodiment of the Multi Use Cathodic Protection System for Steel and Reinforced Concrete placed around a reinforced concrete structure to be provided cathodic protection by the device which is comprised of two Fiberglass Reinforced Plastic Forms (ITEM#6). The two Fiberglass Reinforced Plastic Forms (ITEM#6) are held together to form a jacket by two Click-N-Lock Joint Assemblies (ITEM#4). Each of the two Fiberglass Reinforced Plastic Forms (ITEM#6) having a PVC Port Assembly (ITEM#1), a multiplicity of Spacer/Tensor Assemblies (ITEM#2) that hold the Zinc Anode Mesh (ITEM#9) against the Roughed Inside Surface (ITEM#5) that is attached to the inside surface of the Fiberglass Reinforced Plastic Forms (ITEM#6).

Figure 12:
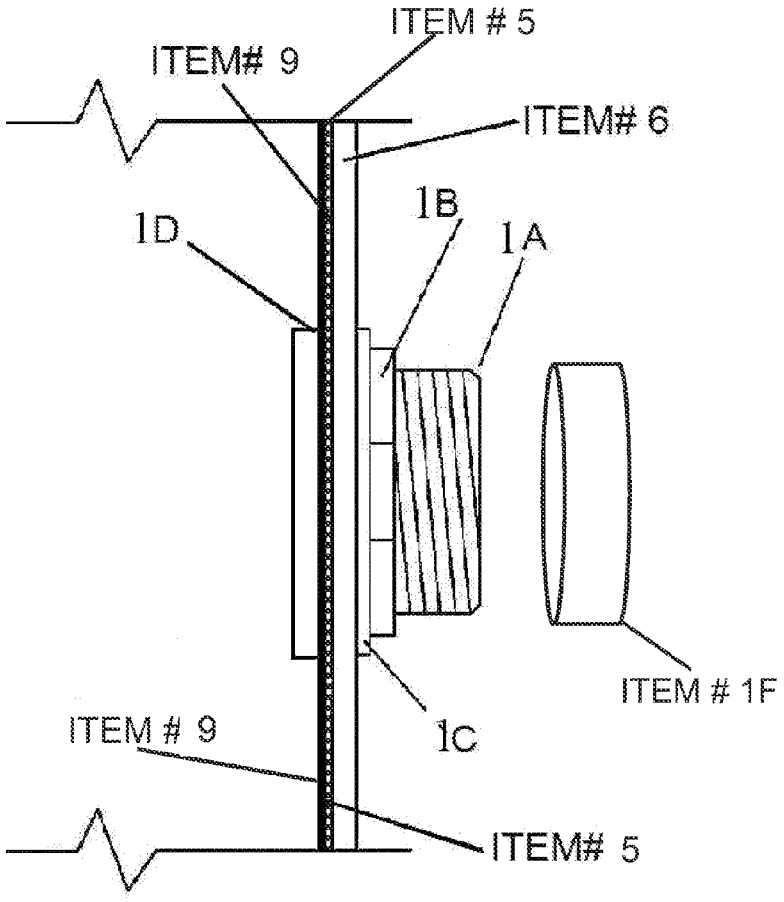
FIG. 12 is a cutaway perspective side view of the PVC Port Assembly of the sacrificial or galvanic anode embodiment of the Multi Use Cathodic Protection System for Steel and Reinforced Concrete placed in an operative position with the Fiberglass Reinforced Plastic Form and attached Zinc Anode Mesh.

FIG. 12 depicts the PVC Port Assembly (ITEM#1) of the sacrificial or galvanic anode embodiment of the Multi Use Cathodic Protection System for Steel and Reinforced Concrete which is further comprised of a PVC Port (1A), a Port Lock Nut (1B), a Port Washer (1C), a Port Seal (1D) and a PVC Port Cap (1F). Also depicted are the Zinc Anode Mesh (ITEM#9) against the Roughed Inside Surface (ITEM#5) that is attached to the inside surface of the Fiberglass Reinforced Plastic Forms (ITEM#6) through which the interior portion of the PVC Port Assembly (ITEM#1) passes.

Figure 13:
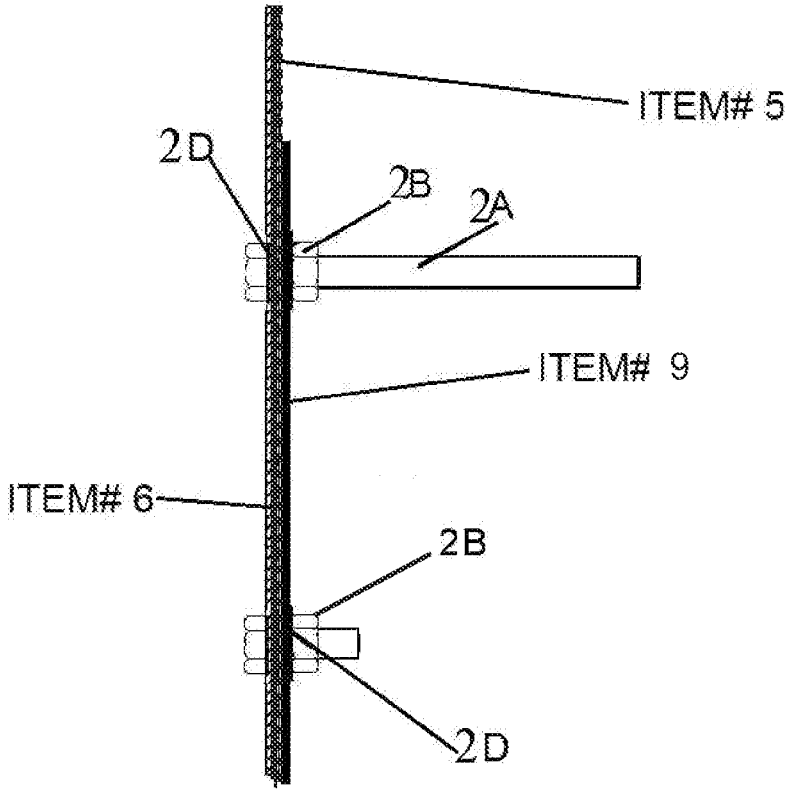
FIG. 13 is a perspective side view of the Spacer/Tensor Assembly of the sacrificial or galvanic anode embodiment of the Multi Use Cathodic Protection System for Steel and Reinforced Concrete attached to the Fiberglass Reinforced Plastic Form with Roughed Inside Surface and attached Zinc Anode Mesh.

FIG. 13 depicts two of the Spacer/Tensor Assemblies (ITEM#2) functionally attached and securing the Zinc Anode Mesh (ITEM#9) against the Roughed Inside Surface (ITEM#5) that is attached to the inside surface of the Fiberglass Reinforced Plastic Forms (ITEM#6). The two Spacer/Tensor Assemblies (ITEM#2) are each depicted therein being further comprised of a Spacer/Tensor Bolt (2A), two Spacer/Tensor Nuts (2B), two Spacer/Tensor Washers (2C), and two Spacer/Tensor O-Rings (2D).

Figure 14:
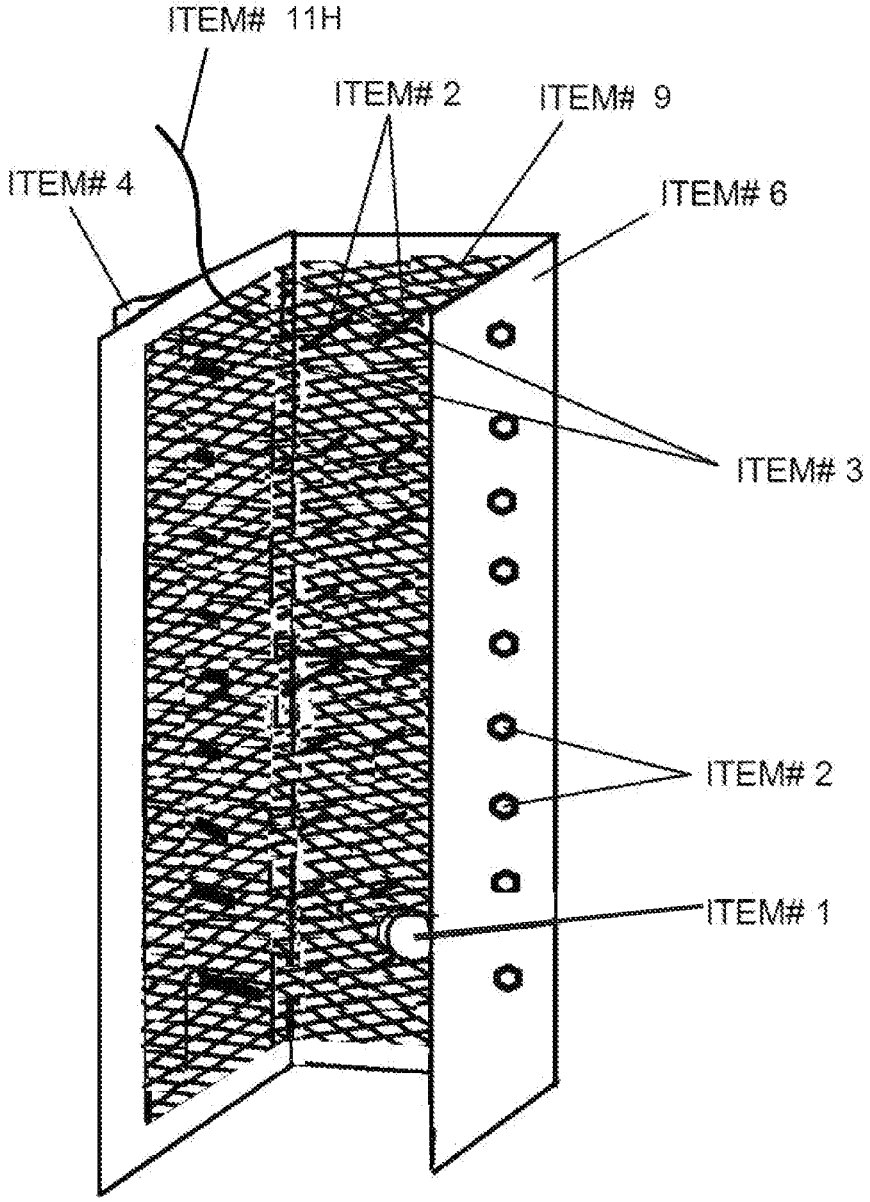
FIG. 14 is a perspective inside view of one of the two Fiberglass Reinforced Plastic Forms used to form the jacket of the sacrificial or galvanic anode embodiment of the Multi Use Cathodic Protection System for Steel and Reinforced Concrete showing the placement of the PVC Port Assembly, the Spacer/Tensor Assemblies, the Bracket/Tie Assemblies, the Click-N-Lock Joint Assembly, the Zinc Anode Mesh, and the Positive Wire From Zinc Anode Mesh.
Figure 15:
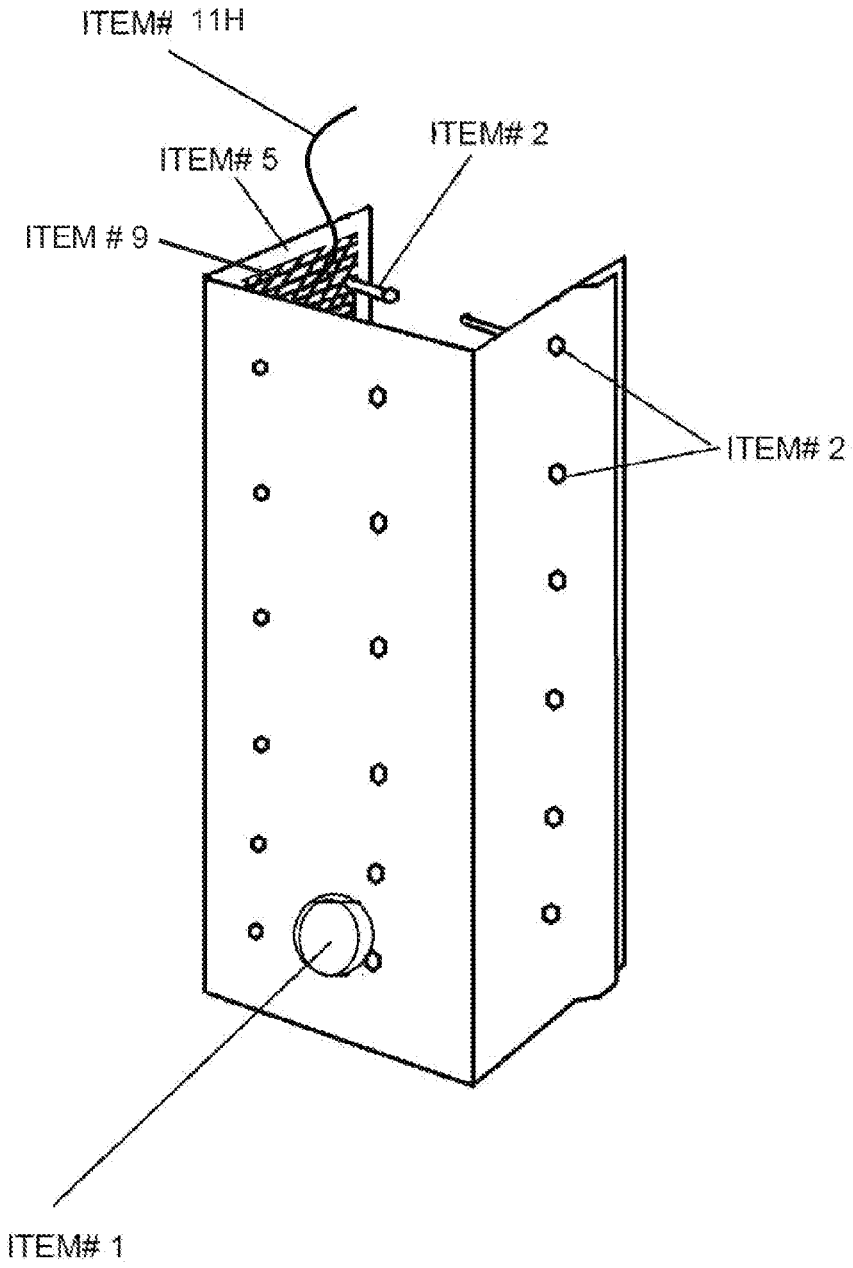
FIG. 15 is a perspective outside view of one of the two Fiberglass Reinforced Plastic Forms used to form the jacket of the sacrificial or galvanic anode embodiment of the Multi Use Cathodic Protection System for Steel and Reinforced Concrete showing the placement of the PVC Port Assembly, the Spacer/Tensor Assemblies, the Bracket/Tie Assemblies, the Click-N-Lock Joint Assembly, the Roughed Inside Surface, the Zinc Anode Mesh, and the Positive Wire From Zinc Anode Mesh.

FIGS. 14-15 depict various perspective views of the Fiberglass Reinforced Plastic Form (ITEM#6) used to form the jacket of the sacrificial or galvanic anode embodiment of the Multi Use Cathodic Protection System for Steel and Reinforced Concrete to show where the various components attach for use of the device.

C. Combination Impressed Current and Sacrificial or Galvanic Anode Embodiment of the Multi Use Cathodic Protection System for Steel and Reinforced Concrete With reference now to the drawings, and in particular to FIGS. 16-20 thereof, are depicted the combination impressed current and sacrificial or galvanic anode embodiment of a new and novel Multi Use Cathodic Protection System for Steel and Reinforced Concrete.

Figure 16:
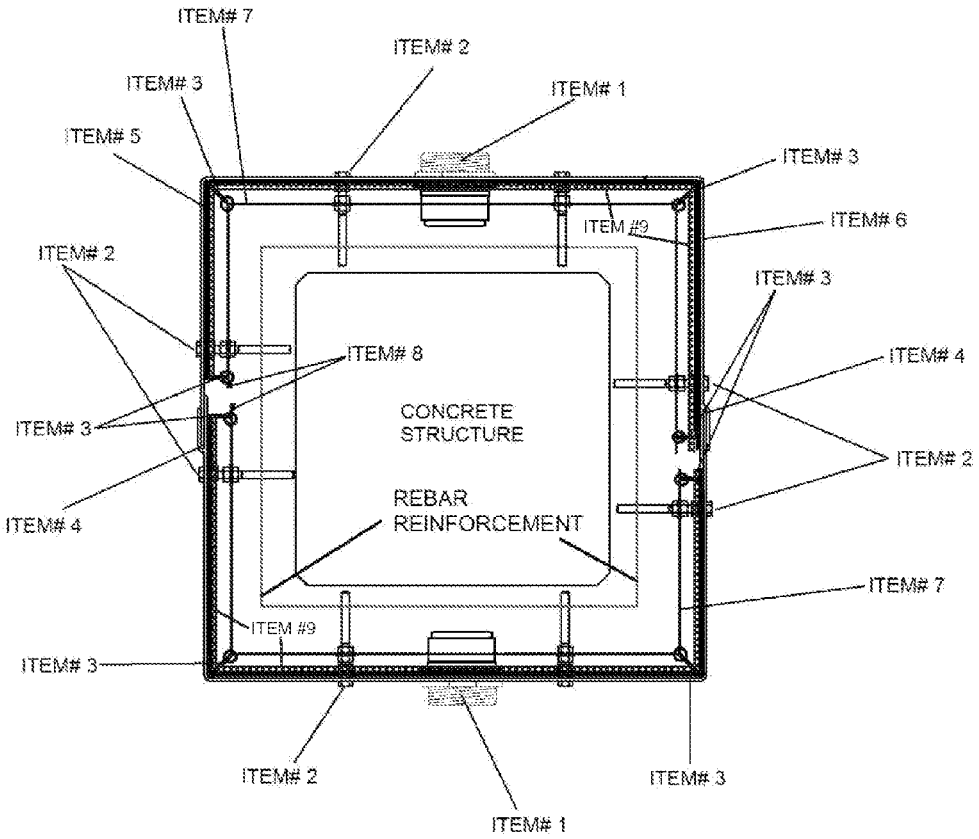
FIG. 16 is a perspective top view of the combination impressed current and sacrificial or galvanic anode embodiment of the Multi Use Cathodic Protection System for Steel and Reinforced Concrete placed in an operative position around a reinforced concrete structure and showing the placement of the PVC Port Assembly, the Spacer/Tensor Assemblies, the Click-N-Lock Joint Assembly, the Roughed Inside Surface, the Zinc Anode Mesh, and the Titanium Mesh.

FIG. 16 depicts the combination impressed current and sacrificial or galvanic anode embodiment of the Multi Use Cathodic Protection System for Steel and Reinforced Concrete placed around a reinforced concrete structure to be provided cathodic protection by the device which is also comprised of two Fiberglass Reinforced Plastic Forms (ITEM#6). The two Fiberglass Reinforced Plastic Forms (ITEM#6) are held together to form a jacket by two Click-N-Lock Joint Assemblies (ITEM#4). Each of the two Fiberglass Reinforced Plastic Forms (ITEM#6) having a PVC Port Assembly (ITEM#1), a multiplicity of Spacer/Tensor Assemblies (ITEM#2) that hold the Zinc Anode Mesh (ITEM#9) against the Roughed Inside Surface (ITEM#5) that is attached to the inside surface of the Fiberglass Reinforced Plastic Forms (ITEM#6). The multiplicity of Spacer/Tensor Assemblies (ITEM#2) also work in conjunction with a multiplicity of Bracket/Tie Assemblies (ITEM#3) to maintain a Titanium Mesh (ITEM#7) at an optimal functional distance from the surface of the Fiberglass Reinforced Plastic Forms (ITEM#6) and the reinforced concrete structure to be provided cathodic protection by the device. Also depicted are the Current Distribution Titanium Bars (ITEM#8) that are spot welded to Titanium Mesh (ITEM#7).

Figure 17:
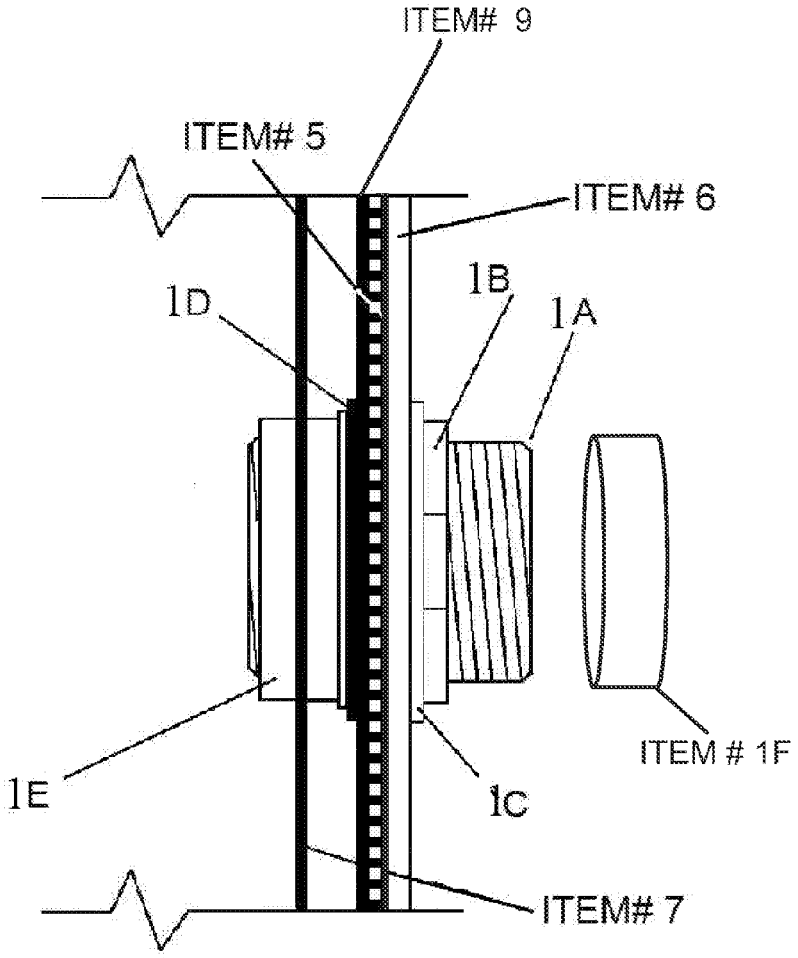
FIG. 17 is a cutaway perspective side view of the PVC Port Assembly of the combination impressed current and sacrificial or galvanic anode embodiment of the Multi Use Cathodic Protection System for Steel and Reinforced Concrete placed in an operative position with the Fiberglass Reinforced Plastic Form with Roughed Inside Surface and the Zinc Anode Mesh and Titanium Mesh being attached in their respective operative positions.

FIG. 17 depicts the PVC Port Assembly (ITEM#1) of the combination impressed current and sacrificial or galvanic anode embodiment of the Multi Use Cathodic Protection System for Steel and Reinforced Concrete which is further comprised of a PVC Port (1A), a Port Lock Nut (1B), a Port Washer (1C), a Port Seal (1D) and a PVC Port Cap (1F). Also depicted are the Zinc Anode Mesh (ITEM#9) against the Roughed Inside Surface (ITEM#5) that is attached to the inside surface of the Fiberglass Reinforced Plastic Forms (ITEM#6) and the Titanium Mesh (ITEM#7) through which the interior portion of the PVC Port Assembly (ITEM#1) passes.

Figure 18:
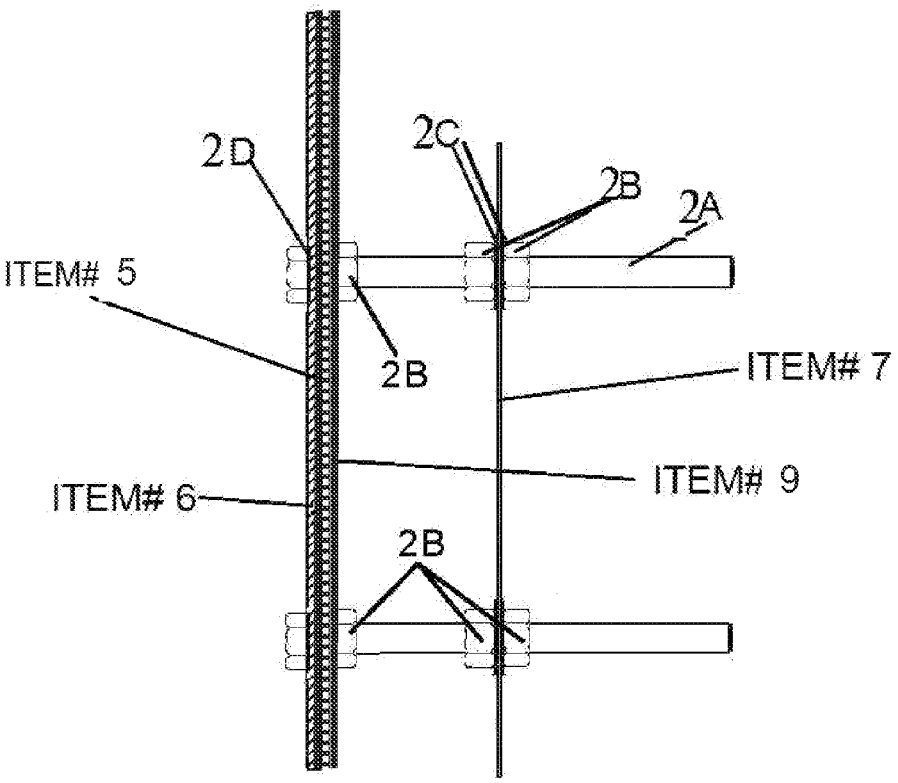
FIG. 18 is a perspective side view of the Spacer/Tensor Assembly of the combination impressed current and sacrificial or galvanic anode embodiment of the Multi Use Cathodic Protection System for Steel and Reinforced Concrete attached to the Fiberglass Reinforced Plastic Form with Roughed Inside Surface and the Zinc Anode Mesh and Titanium Mesh being attached in their respective operative positions.

FIG. 18 depicts two of the Spacer/Tensor Assemblies (ITEM#2) functionally attached and securing the Zinc Anode Mesh (ITEM#9) against the Roughed Inside Surface (ITEM#5) that is attached to the inside surface of the Fiberglass Reinforced Plastic Forms (ITEM#6) and also securing in operative position the Titanium Mesh (ITEM#7). The two Spacer/Tensor Assemblies (ITEM#2) are each depicted therein being further comprised of a Spacer/Tensor Bolt (2A), four Spacer/Tensor Nuts (2B), four Spacer/Tensor Washers (2C), and two Spacer/Tensor O-Rings (2D).

Figure 19:
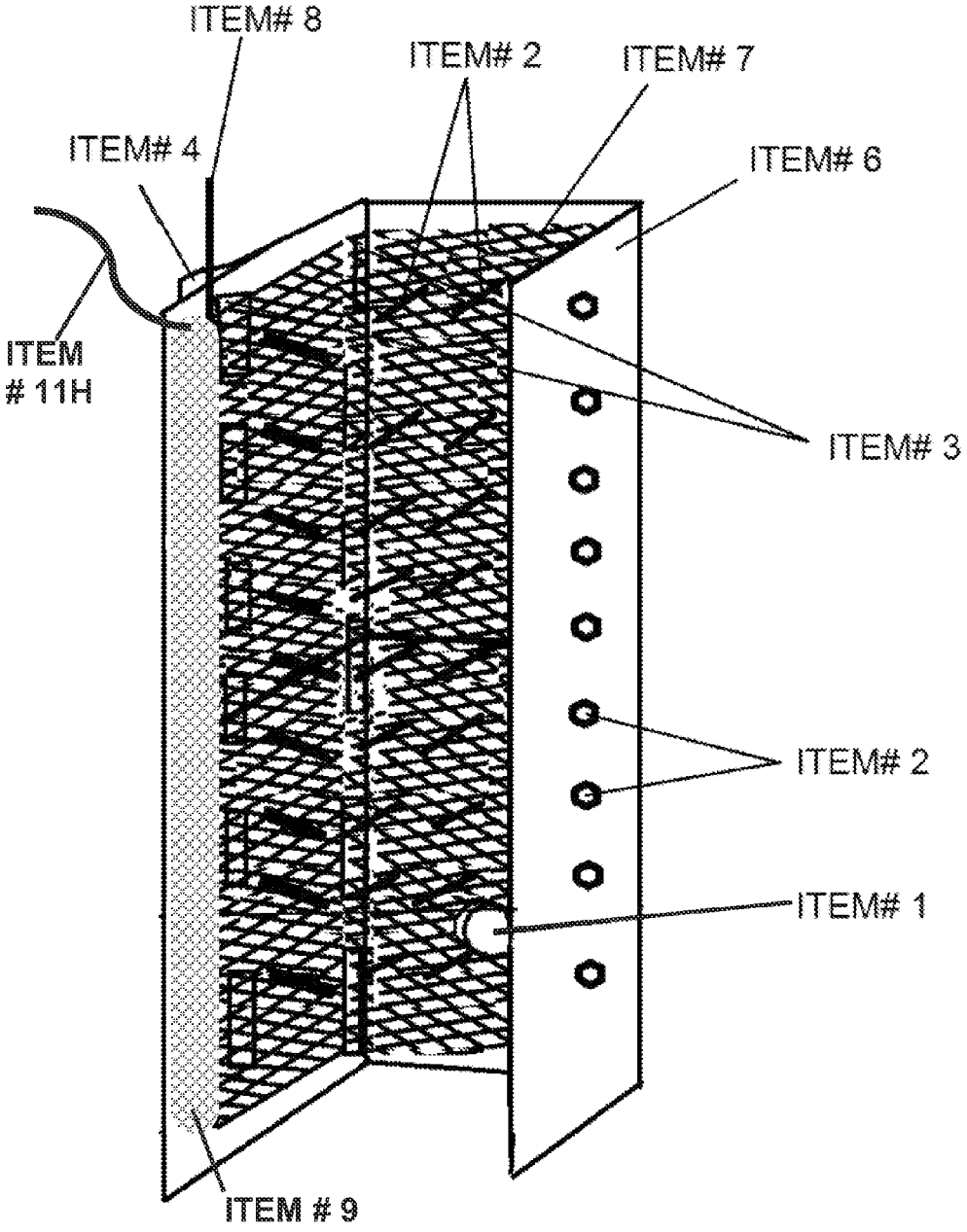
FIG. 19 is a perspective inside view of one of the two Fiberglass Reinforced Plastic Forms used to form the jacket of the combination impressed current and sacrificial or galvanic anode embodiment of the Multi Use Cathodic Protection System for Steel and Reinforced Concrete showing the placement of the PVC Port Assembly, the Spacer/Tensor Assemblies, the Bracket/Tie Assemblies, the Click-N-Lock Joint Assembly, the Zinc Anode Mesh, the Positive Wire From Zinc Anode Mesh, the Titanium Mesh and the Current Distribution Titanium Bar.

FIG. 19 depicts an interior perspective view of the Fiberglass Reinforced Plastic Form (ITEM#6) used to form the jacket of the combination impressed current and sacrificial or galvanic anode embodiment of the Multi Use Cathodic Protection System for Steel and Reinforced Concrete to show where the various components attach for use of the device. Also depicted are the attached Zinc Anode Mesh (ITEM#9) and the Titanium Mesh (ITEM#7) secured in their respective operative positions.

Figure 20:
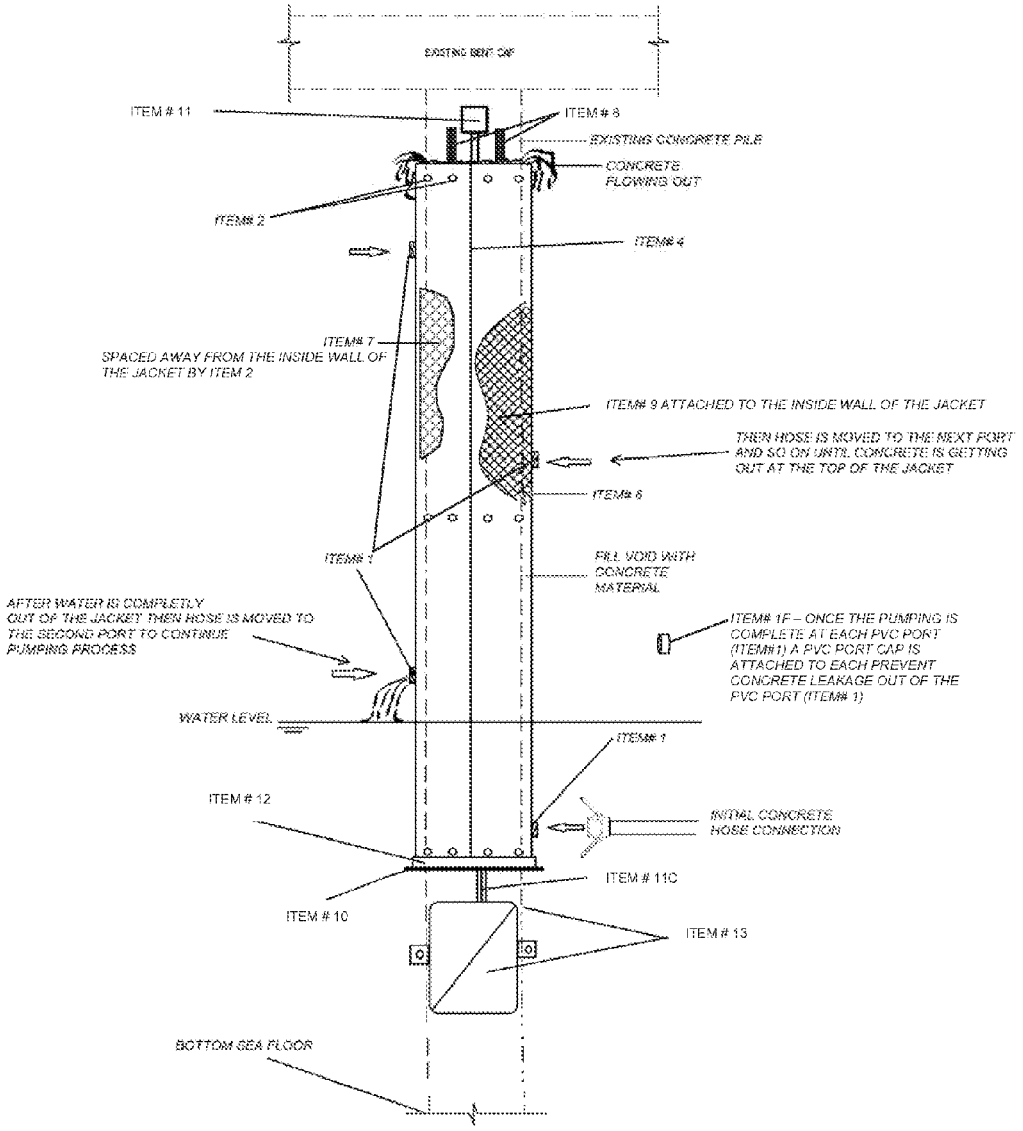
FIG. 20 is a perspective view of the two Fiberglass Reinforced Plastic Forms snapped together to form the jacket of the combination impressed current and sacrificial or galvanic anode embodiment of the Multi Use Cathodic Protection System for Steel and Reinforced Concrete in place around a reinforced concrete structure to be provided cathodic protection by the device showing the placement of the PVC Port Assemblies and describing the process of filling the device with concrete and also depicting in cutaway views the Zinc Anode Mesh and the Titanium Mesh.

FIG. 20 depicts the combination impressed current and sacrificial or galvanic anode embodiment of the Multi Use Cathodic Protection System for Steel and Reinforced Concrete fully assembled around a partially submerged reinforced concrete structure to be cathodically protected and specifying the concrete pumping steps to fill the device with concrete and voiding the interior of the device of water. Also depicted is the Plywood Support Platform (ITEM#10) that is installed as a temporary structure to support Fiberglass Reinforced Plastic Bottom Form (ITEM#12) of the device during the process of assembly of the device and process of filling assembled device with concrete for use. The sacrificial or galvanic anode components of this combination embodiment as depicted is electro-conductively attached to a user selected steel or steel reinforced structure to be cathodically protected by means of an Electrical Junction Box (ITEM#11) which is the same as depicted in FIG. 10 as being further comprised of two Negative Wire From Outside Steel Reinforcement (11D) and two Negative Wire From Inside Pile Steel (11E) which in turn are each removably attached to a Non-Corrosive Electrical Block (11B) capable of carrying a current to and through a Shunt (11A) to a second Non-Corrosive Electrical Block (11B) upon which are removably attached: a Bulk Anode Wire (11C) capable of carrying a current to at least one Full Pile Width Bulk Anode (ITEM#13); and two Positive Wire From Zinc Anode Mesh (11H) that is conductively connected to the Zinc Anode Mesh (ITEM#9). The electrical components of this combination embodiment are protected from the environment by being contained within a Non-Corrosive Box (11F) and Non-Corrosive Conduit (11G) as depicted in FIG. 10. Also depicted in FIG. 20 is the Titanium Mesh (ITEM#7) which is attached by a multiplicity of Spot Welds (7A) to the Current Distribution Titanium Bar (ITEM#8) as further depicted in FIG. 4B. This combination embodiment incorporates all the features and component parts of the impressed current embodiment depicted in FIGS. 1-9 with all the features and component parts of the sacrificial or galvanic anode embodiment depicted in FIGS. 10-16.

General Description of Reference Numerals in the Description and Drawings

Any actual dimensions listed are those of the preferred embodiments. Actual dimensions or exact hardware details and means may vary in a final product or most preferred embodiments and should be considered means for so as not to narrow the claims of the patent.

LIST AND DESCRIPTION OF COMPONENT PARTS OF THE INVENTION (ITEM#1) PVC Port Assembly
(1A) PVC Port
(1B) Port Lock Nut
(1C) Port Washer
(1D) Port Seal
(1E) Port Mesh Holder
(1F) PVC Port Cap
(ITEM#2) Spacer/Tensor Assembly
(2A) Spacer/Tensor Bolt
(2B) Spacer/Tensor Nut
(2C) Spacer/Tensor Washer
(2D) Spacer/Tensor O-Ring
(ITEM#3) Bracket/Tie Assembly
(3A) Fiberglass Reinforced Plastic Bracket
(3B) Bracket/Tie Holes
(3C) Bracket/Tie Tie
(ITEM#4) Click-N-Lock Joint Assembly
(4A) Clasp
(4B) Clasp Insert
(ITEM#5) Roughed Inside Surface
(ITEM#6) Fiberglass Reinforced Plastic Form
(ITEM#7) Titanium Mesh
(7A) Spot Weld
(ITEM#8) Current Distribution Titanium Bar
(ITEM#9) Zinc Anode Mesh
(ITEM#10) Plywood Support Platform
(ITEM#11) Electrical Junction Box
(11A) Shunt
(11B) Non-Corrosive Electrical Block
(11C) Bulk Anode Wire
(11D) Negative Wire From Outside Steel Reinforcement
(11E) Negative Wire From Inside Pile Steel
(11F) Non-Corrosive Box
(11G) Non-Corrosive Conduit
(11H) Positive Wire From Zinc Anode Mesh
(ITEM#12) Fiberglass Reinforced Plastic Bottom Form
(12A) Water Ports
(12B) Pile Seal
(12C) Tongue and Groove Connector
(12D) Jacket Attachment Holes
(ITEM#13) Full Pile Width Bulk Anode

Detailed Description of the Preferred Embodiments

The three embodiments of the Multi Use Cathodic Protection System for Steel and Reinforced Concrete are comprised of the component parts as depicted in FIGS. 1-20 which are used, manufactured and comprised of the following components in their respective functional relationships:

The main structural element of all three embodiments of the Multi Use Cathodic Protection System for Steel and Reinforced Concrete are comprised of two Fiberglass Reinforced Plastic Forms (ITEM#6) attached to which are all the component parts of the device assembled in a similar manner on each embodiment depending upon the overall length of the Fiberglass Reinforced Plastic Forms (ITEM#6) being used in a particular application and the number PVC Port Assemblies (ITEM#1) determined by the user to be necessary to pump the device full of concrete while simultaneously forcing all of the water out of the void being filled with the concrete, thereby preventing chloride and mineral contamination of the Titanium Mesh (ITEM#7) and the Zinc Anode Mesh (ITEM#9). The Fiberglass Reinforced Plastic Forms (ITEM#6) ideally will be molded or cast using twenty (20) ounces per square foot or heavier of fiberglass reinforced plastic matting. A Roughed Inside Surface (ITEM#5) is attached to the inside surface of the Fiberglass Reinforced Plastic Forms (ITEM#6) in all three embodiments of this device.

In the use of all three embodiments a user will removably attach to a steel or steel reinforced concrete structure to be cathodically protected a Plywood Support Platform (ITEM#10) at a user selected location in a user selected manner. The user will then place on top of the Plywood Support Platform (ITEM#10) the two components that comprise the Fiberglass Reinforced Plastic Bottom Form (ITEM#12) which are then attached to each other by means of the Tongue and Groove Connector (12C) to form a complete bottom around a reinforced concrete or steel structure in close enough proximity to prevent concrete leakage upon infusion of concrete by means of the Pile Seals (12B). On top of the assembled Fiberglass Reinforced Plastic Bottom Form (ITEM#12) and attached with a concrete leakproof fit by means of the Jacket Attachment Holes (12D) and user selected hardware are the two Fiberglass Reinforced Plastic Forms (ITEM#6) which have been snapped together to form a jacket around the reinforced concrete or steel structure to be cathodically protected by the device with a concrete leakproof seal formed by the locking of the two Fiberglass Reinforced Plastic Forms (ITEM#6) together by inserting the Clasp Insert (4B) of the Click-N-Lock Joint Assembly (ITEM#4) that is attached to the Fiberglass Reinforced Plastic Forms (ITEM#6) into the Clasp (4A). The Click-N-Lock Joint Assembly (ITEM#4) can be attached to the Fiberglass Reinforced Plastic Forms (ITEM#6) in many different ways including by use of adhesives such as FRP Resin. Once the Fiberglass Reinforced Plastic Forms (ITEM#6) are snapped and locked together to form a jacket around a reinforced concrete or steel structure to be cathodically protected by the device the Click-N-Lock Joint Assembly (ITEM#4) functions to prevent the jacket from opening or permitting leakage when concrete is being pumped into all three embodiments of the device.

The two Fiberglass Reinforced Plastic Forms (ITEM#6) each have at least one PVC Port Assembly (ITEM#1) or in the case of larger installations a multiplicity of PVC Port Assemblies (ITEM#1) which are staggered along the whole Fiberglass Reinforced Plastic Forms (ITEM#6) as depicted in FIG. 9 that permit the attachment of hoses to the exterior of the device once fully assembled in place for use and will permit the passage of pumped uncured concrete to the inside of the Impress Current Jacket for Steel and Reinforced Concrete device and simultaneously forcing water out of the jacket formed by the device by the concrete pumping process. The PVC Ports (1A) of the PVC Port Assemblies (ITEM#1) pass through a hole in the Fiberglass Reinforced Plastic Forms (ITEM#6) with a threaded end of the PVC Ports (1A) remaining on the outside of the jacket formed by the device and the PVC Ports (1A) are held in place to form a leakproof seal by a Port Lock Nut (1B), a Port Washer (1C), and a Port Seal (1D). In all three embodiments, once the concrete that is being pumped into the device reaches the level of each PVC Port (1A) above the PVC Port (1A) into which the concrete is being pumped, or out of the top of the device once the device in filled with concrete, the concrete pump hose is removed from the PVC Port (1A) and the concrete is prevented from draining out of the device by attaching a PVC Port Cap (1F) to the corresponding PVC Port (1A) as depicted in FIGS. 9, 10 and 20. As depicted in FIGS. 1, 2, 5 and 6 the PVC Ports (1A) of the PVC Port Assemblies (ITEM#1) of the impressed current embodiment pass through a hole in the Titanium Mesh (ITEM#7) which is secured there in its operative position by a Port Mesh Holder (1E). Similarly as depicted in FIGS. 11, 12 and 14 the PVC Ports (1A) of the PVC Port Assemblies (ITEM#1) of the sacrificial or galvanic anode embodiment pass through a hole in the Zinc Anode Mesh (ITEM#9) which is secured there in its operative position by being attached to the Roughed Inside Surface (ITEM#5).

Cathodic protection is achieved with the impressed current embodiment and the combination impressed current and sacrificial or galvanic anode embodiment by impressing a direct current (DC) to the Titanium Mesh (ITEM#7). This is achieved by electrically attaching a user selected DC power source to Current Distribution Titanium Bars (ITEM#8) to form an anode thereby. Electrical current will flow from the user selected DC power source to the Current Distribution Titanium Bar (ITEM#8) then it will flow through the Spot Welds (7A) that electroconductively and rigidly secure the Current Distribution Titanium Bar (ITEM#8) to the Titanium Mesh (ITEM#7). Once the current is impressed upon the Titanium Mesh (ITEM#7) it becomes a anode that will provide cathodic corrosion protection for the user selected reinforced concrete or steel structure to be cathodically protected by the device.

Cathodic protection is also achieved with the sacrificial or galvanic anode and the combination impressed current and sacrificial or galvanic anode embodiments by creating a electrically conductive pathway from the steel structure or the steel within a steel reinforced concrete structure to the Zinc Anode Mesh (ITEM#9) to the aquatic environment. This is achieved in both embodiments that utilize a sacrificial or galvanic anode by electro-conductively attaching the Zinc Anode Mesh (ITEM#9) to a user selected steel or steel reinforced structure to be cathodically protected by means of an Electrical Junction Box (ITEM#11) during the assembly of the device and prior to the pouring of concrete into the device. The Electrical Junction Box (ITEM#11) comprised of two Negative Wire From Outside Steel Reinforcement (11D) and two Negative Wire From Inside Pile Steel (11E) which in turn are each removably attached to a Non-Corrosive Electrical Block (11B) capable of carrying a current to and through a Shunt (11A) to a second Non-Corrosive Electrical Block (11B) upon which are removably attached: a Bulk Anode Wire (11C) capable of carrying a current to at least one Full Pile Width Bulk Anode (ITEM#13); and two Positive Wire From Zinc Anode Mesh (11H) that is conductively connected to the Zinc Anode Mesh (ITEM#9). The electrical components are protected from the environment by being contained within a Non-Corrosive Box (11F) and Non-Corrosive Conduit (11G). Once the sacrificial or galvanic anode system in both embodiments is charged the Zinc Anode Mesh (ITEM#7) and the Full Pile Width Bulk Anode (ITEM#13) become sacrificial anodes that will provide cathodic corrosion protection for the user selected reinforced concrete or steel structure to be cathodically protected by the device. The advantage of the combination impressed current and sacrificial or galvanic anode embodiment is that if the DC power source needed for the impressed current component of the embodiment fails in any way the sacrificial or galvanic anode component of the embodiment will continue functioning providing cathodic protection since it does not require an external power supply.

In order for the Titanium Mesh (ITEM#7) in the impressed current or the sacrificial or galvanic anode embodiments to function effectively as a cathodic corrosion protection system the Titanium Mesh (ITEM#7) must be maintained at the proper functional distances from the user selected reinforced concrete or steel structure to be cathodically protected by the device and the interior surface of the jacket formed by the locked Fiberglass Reinforced Plastic Forms (ITEM#6). As noted above the prior art systems do not effectively maintain the positioning or integrity of the anodes used in those systems. To accomplish this my invention uses a combination of spacing and support features that is not known or practiced in the prior art. A multiplicity of holes are made at user selected locations through the Fiberglass Reinforced Plastic Forms (ITEM#6) through which nylon or plastic Spacer/Tensor Assemblies (ITEM#2) are placed and secured by means of a nylon or plastic Spacer/Tensor Bolt (2A) and a nylon or plastic Spacer/Tensor Nut (2B) and rendered leakproof by use of a Spacer/Tensor O-Ring (2D). The Titanium Mesh (ITEM#7) is attached to the Spacer/Tensor Assemblies (ITEM#2) at the user selected distance from the Fiberglass Reinforced Plastic Forms (ITEM#6) and the user selected reinforced concrete or steel structure to be cathodically protected by the device by passing the Spacer/Tensor Bolt (2A) through the Titanium Mesh (ITEM#7) and securing the Titanium Mesh (ITEM#7) at the user selected distance by sandwiching it between two Spacer/Tensor Washers (2C) that are held securely against the Titanium Mesh (ITEM#7) on each side by a Spacer/Tensor Nut (2B). In the sacrificial or galvanic anode embodiment and the combination impressed current and sacrificial or galvanic anode embodiment the Zinc Anode Mesh (ITEM#9) is attached to the Roughed Inside Surface (ITEM#5) by means of the Spacer/Tensor Assemblies (ITEM#2) which secure the Zinc Anode Mesh (ITEM#9) in the optimal location in the device to function as a sacrificial or galvanic anode.

To further secure and maintain the Titanium Mesh (ITEM#7) of the impressed current embodiment and the combination impressed current and sacrificial or galvanic anode embodiment in the optimally functional position within the device a multiplicity of Bracket/Tie Assemblies (ITEM#3) are attached to the Fiberglass Reinforced Plastic Forms (ITEM#6) typically by means of an effective waterproof adhesive such as epoxy to user selected locations to provide optimal support and rigidity of the Titanium Mesh (ITEM#7) which may include the corners formed by the Fiberglass Reinforced Plastic Forms (ITEM#6). The Bracket/Tie Assemblies (ITEM#3) are then attached to the Titanium Mesh (ITEM#7) by tying to it each of the Fiberglass Reinforced Plastic Brackets (3A) of the Bracket/Tie Assemblies (ITEM#3) with at least one Bracket/Tie (3C) by passing the Bracket/Tie (3C) through and back over the lattice of the Titanium Mesh (ITEM#7) and then through a Bracket/Tie Hole (3B) and then drawing the Titanium Mesh (ITEM#7) securely up against the Fiberglass Reinforced Plastic Brackets (3A) by the process of tightly tying it thereto.

To further secure and maintain the Titanium Mesh (ITEM#7) of the impressed current embodiment and the combination impressed current and sacrificial or galvanic anode embodiment in the optimally functional position within the device and prevent bending or the mispositioning of the Titanium Mesh (ITEM#7) by the forces generated when concrete is pumped into the device, a hole is made in the Titanium Mesh (ITEM#7) such that the PVC Ports (1A) of the PVC Port Assemblies (ITEM#1) pass through the hole the Titanium Mesh (ITEM#7) and is then rigidly secured to the Titanium Mesh (ITEM#7) by a Port Mesh Holder (1E).

Another feature of this device that is engineered to maximize the bond between the device and the concrete that is poured into the device is the attachment of a Roughed Inside Surface (ITEM#5) to the Fiberglass Reinforced Plastic Forms (ITEM#6). This may be accomplished by a separate component as depicted in the drawings and attached typically with waterproof adhesive such as FRP resin. This type of functional roughed surface may also be cast or etched into the Fiberglass Reinforced Plastic Forms (ITEM#6) thereby eliminating the need for a separate part.

Once the fully assembled and locked device of all three embodiments is in place for use the electrical components of each embodiment are maintained at the user selected functional distance from the reinforced concrete or steel structure to be cathodically protected by the device with the Spacer/Tensor Bolts (2A) as depicted in FIGS. 1, 11 and 16. Once the user has the device in place, to complete the installation of all three embodiments, the user will attach a concrete pumping means to the PVC Ports (1A) of the PVC Port Assemblies (ITEM#1) and will commence pumping concrete through the PVC Ports (1A) into the device in a stepped procedure as depicted in FIGS. 9, 10 and 20 starting at the PVC Port Assembly (ITEM#1) nearest the ground until all the water is voided from the device up to the next highest PVC Port Assembly (ITEM#1), then the pumping process will continue from that next highest PVC Port Assembly (ITEM#1) and the process will be repeated at the next highest PVC Port Assembly (ITEM#1) until the jacket formed by the device is full of the pumped concrete and all the water has been voided from inside the jacket formed by the device. In all three embodiments, once the concrete that is being pumped into the device reaches the level of each PVC Port (1A) above the PVC Port (1A) into which the concrete is being pumped, or out of the top of the device once the device in filled with concrete, the concrete pump hose is removed from the PVC Port (1A) and the concrete is prevented from draining out of the device by attaching a PVC Port Cap (1F) to the corresponding PVC Port (1A) as depicted in FIGS. 9, 10 and 20. By pumping the concrete between the Titanium Mesh (ITEM#7), the Zinc Anode Mesh (ITEM#9) and the reinforced concrete or steel structure to be cathodically protected by the device the risk of damage to the Titanium Mesh (ITEM#7) and the Zinc Anode Mesh (ITEM#9) is greatly reduced, if not eliminated. Prior art devices permit the concrete to be poured directly against the anodes in those systems which bend and in some cases tear the anodes thereby ruining those devices' effectiveness as a cathodic protection system. Once the device is filled with concrete the concrete pumping is terminated and the pumping means is disconnected from the device.

To complete the installation of both the impressed current embodiment and the combination impressed current and sacrificial or galvanic anode embodiment for use, the DC power source and user selected electronic controls are then conductively and functionally attached to the Current Distribution Titanium Bars (ITEM#8) and the reinforced concrete or steel structure to be cathodically protected by the device. Once the DC current is impressed upon the device the reinforced concrete or steel structure to be cathodically protected by the device will be cathodically protected from corrosion.

Lastly once both the sacrificial or galvanic anode embodiment and the combination impressed current and sacrificial or galvanic anode embodiment are assembled and the concrete has been poured and cured the Plywood Support Platform (ITEM#10) is removed and a multiplicity of Water Ports (ITEM#12A) are created in the Fiberglass Reinforced Plastic Bottom Form (ITEM#12) to facilitate direct water contact with the Zinc Anode Mesh (ITEM#9) and surrounding concrete to facilitate the flow of electricity through the Zinc Anode Mesh (ITEM#9) from the steel or steel reinforced concrete structure being cathodically protected.

While the foregoing written description of the invention enables one of ordinary skill to make and use what is considered presently to be the best mode thereof, those of ordinary skill will understand and appreciate the existence of variations, shapes, sizes, combinations, and equivalents of the specific embodiment, method, and examples herein. For example it would be obvious to include a temporary support system other than plywood for use in the assembly and concrete pouring process. It would also be obvious to cast the base into the jacket as one part rather than have a separate base or to have the jacket and base all as one piece for installation on structures that would facilitate such an installation. Additionally it would be obvious to substitute the various nylon and pvc parts with other similar non-conductive corrosion resistant materials. The use of titanium as the anode similarly could be substituted with other suitable materials. Additionally the sacrificial or galvanic anode could be made of some other suitable materials. Accordingly, the scope of the invention should be determined not by the embodiments illustrated, but by the claims and their legal equivalents which accompany this application.

Having described my invention, I claim:

1. A multi use cathodic protection system for steel and reinforced concrete comprised of:

a jacket wherein the jacket is further comprised of at least two forms that are attached together by an attachment means selected from at least one of the group consisting of: an epoxy; at least one strap; a multiplicity of nuts and bolts; a hook and loop fastener; or a click in and lock latch assembly thereby forming the jacket and wherein the jacket is capable of surrounding a structure to be protected from corrosion;

the jacket being further comprised of a top opening and a bottom opening;

the forms being further comprised of attached spacers which will maintain the jacket at a user selected distance from the structure to be protected from corrosion;

a base attached to the bottom opening of the jacket thereby forming a container surrounding the structure to be protected from corrosion such that the container is capable of containing a poured casting substance therein and surrounding the structure to be protected from corrosion with the poured casting substance;

the forms having an inside surface and an outside surface wherein the inside surface of the forms together form an inside surface of the jacket portion of the container;

a separate roughed surface component attached to the inside surface of the forms to increase the surface area of the inside surface of the jacket for bonding of the poured casting substance;

at least one corrosion protection means attached to each of the forms selected from the group consisting of: a sacrificial anode or an impressed current anode, wherein the corrosion protection means are rigidly attached to the inside surface of each of the forms by at least one non-conductive and corrosion resistant hardware means selected from the group consisting of: nuts and bolts or brackets and ties, wherein the corrosion protection means will remain in a user determined position inside the container by at least one of the non-conductive and corrosion resistant hardware means while the container is being filled with the poured casting substance and the corrosion protection means will also remain in the user determined position once the poured casting substance solidifies;

at least one poured casting substance port attached to at least one of the forms wherein the poured casting substance port forms a port capable of permitting the poured casting substance to pass from outside of the container to inside of the container and exiting the poured casting substance port between the structure to be protected from corrosion and the corrosion protection means;

the poured casting substance port being capable of being removably attached to a poured casting substance pumping means wherein the poured casting substance is pumped through the poured casting substance port to the inside of the container;

a poured casting substance port cap wherein the poured casting substance port cap is attached to the poured casting substance port after the pumping of the poured casting substance thereby preventing the poured casting substance from draining out of the container; and at least one electrically conductive connection means attached to each corrosion protection means selected from the group consisting of: an electrically conductive connection of a direct current power supply across the impressed current anode and the structure to be protected from corrosion or an electrically conductive connection of the sacrificial anode and the structure to be protected from corrosion.

2. The multi use cathodic protection system for steel and reinforced concrete of claim 1 wherein the forms are comprised of fiberglass reinforced plastic.

3. The multi use cathodic protection system for steel and reinforced concrete of claim 1 wherein the base has a multiplicity of holes placed in user selected locations to facilitate water making contact with the solidified poured casting substance.

4. The multi use cathodic protection system for steel and reinforced concrete of claim 1 wherein the sacrificial anode is comprised of zinc.

5. The multi use cathodic protection system for steel and reinforced concrete of claim 1 wherein the sacrificial anode is comprised of an alloy of aluminum, zinc and indium.

6. The multi use cathodic protection system for steel and reinforced concrete of claim 1 wherein the sacrificial anode is electro-conductively connected to at least one bulk sacrificial anode comprised of materials selected from the group consisting of: zinc or an alloy of aluminum, zinc and indium, wherein the bulk sacrificial anode is attached to structure to be protected from corrosion outside of and below the container formed by the jacket and the base.

7. The multi use cathodic protection system for steel and reinforced concrete of claim 1 wherein the impressed current anode is comprised of titanium.

8. The multi use cathodic protection system for steel and reinforced concrete of claim 1 wherein the poured casting substance is comprised of concrete.

9. The multi use cathodic protection system for steel and reinforced concrete of claim 1 wherein the electrically conductive connection means is comprised of corrosion resistant electrically conductive materials selected from the group consisting of: stainless steel; gold; platinum; tungsten; titanium; or nitinol.

10. The multi use cathodic protection system for steel and reinforced concrete of claim 1 wherein the direct current power supply is selected from the group consisting of: a battery or a rectifier.

11. A method of using the multi use cathodic protection system for steel and reinforced concrete of claim 1 consisting of the steps of:

identifying the structure to be protected from corrosion;

determining a location on the structure to be protected from corrosion where the multi use cathodic protection system will be installed;

calculating a length, width and number of the forms that will comprise the jacket once assembled that will be needed to surround the structure to be protected from corrosion such that the user selected corrosion protection means once attached to the forms will be situated inside the container formed by the jacket and the base at user determined distances from the structure to be protected from corrosion and the inner surface of the forms;

calculating a number and location of poured casting substance ports that will be needed to be attached to the forms based upon the calculated length and width of the forms in order to be able to effectively pump and fill the container formed by the jacket and the base with the poured casting substance while simultaneously displacing and evacuating the water that may have been contained in the container by permitting the poured casting substance to be pumped through the poured casting substance port from outside of the container formed by the jacket and the base to the inside of the container formed by the jacket and the base;

attaching the user calculated number of poured casting substance ports to the forms in the user calculated locations;

attaching the separate roughed surface component to the inside surface of the forms;

attaching the user selected corrosion protection means to the inner surface of the forms that are of the calculated length, width and number by means of the user selected non-conductive and corrosion resistant hardware means such that the user selected corrosion protection means are rigidly held in place and will not deform from the pressure caused by the filling of the jacket with the poured casting substances;

attaching the spacers to the forms;

attaching a temporary support platform to the structure to be protected from corrosion that is capable of supporting in the user selected location on the structure to be protected from corrosion the fully assembled multi use cathodic protection system once it is pumped full of the poured casting substance;

placing the base on top of the temporary support platform;

assembling the jacket around the structure to be protected from corrosion by attaching the forms together with the user selected attachment means;

attaching the assembled jacket to the base;

attaching the user selected electrically conductive connection means to the user selected corrosion protection means;

charging and testing the user selected electrically conductive connection means to determine that all electrical circuits are complete such that the user selected corrosion protection means are properly functioning as an anode and if not then checking and repairing the attachment of the user selected electrically conductive connection means to the user selected corrosion protection means;

attaching to the poured casting substance port that is nearest the ground surface the poured casting substance pumping means;

pumping the poured casting substance into the container formed by the jacket and the base until the poured casting substance reaches the next highest poured casting substance port or the top opening of the jacket if there are no poured casting substance ports above the poured casting substance port that is connected to the poured casting substance pumping means;

deactivating the poured casting substance pump means;

disconnecting the poured casting substance pump means from the poured casting substance port;

capping the poured casting substance port that was just disconnected from the poured casting substance pump means with the poured casting substance port cap as quickly as possible to prevent the poured casting substance from draining out of the container through the poured casting substance port that was just disconnected from the poured casting substance pump means;

repeating the connection and pumping of the poured casting substance through the poured casting substance ports moving progressively up from the poured casting substance ports closest to the ground until the jacket is completely full with the poured casting substance to the top opening of the jacket and the water that was in the container has been voided from the container;

tapering the poured casting substance upwardly toward the structure to be protected from corrosion thereby promoting runoff from the top surface of the device once the poured casting substance has solidified;

waiting for a sufficient amount of time for the poured casting substance to solidify;

removing the temporary support platform thereby exposing the bottom of the base;

drilling holes in the base in order to facilitate water contact with the solidified poured casting substance inside the container formed by the jacket and the base; and retesting the user selected electrically conductive connection means to determine that all electrical circuits are complete such that the user selected corrosion protection means are properly functioning as an anode.

* * * * *